US005755884A

United States Patent [19]

Buckler et al.

[11] Patent Number: 5,755,884

[45] Date of Patent: May 26, 1998

[54] COATING ASSEMBLY WITH PRESSURE SENSING TO DETERMINE NOZZLE CONDITION

[75] Inventors: Jeffrey M. Buckler, Brookfield, Wis.; Harald Pleuse, Gauteng, South Africa; Daniel Pinault, Noisiel, France

[73] Assignee: Nordson Corporation, Westlake, Ohio

[21] Appl. No.: 693,897

[22] Filed: Aug. 5, 1996

Related U.S. Application Data

[63] Continuation-in-part of Ser. No. 632,351, Apr. 10, 1996, abandoned.

[51] Int. Cl.[6] ..... B05B 13/06; B05C 5/00

[52] U.S. Cl. ..... 118/317; 118/684; 118/685; 118/712; 239/68; 239/71; 239/124

[58] Field of Search ..... 118/684, 685, 118/317, 712; 137/599; 73/37, 709, 714, 861.42; 239/68, 71, 74, 124, 127, 600

[56] References Cited

U.S. PATENT DOCUMENTS

| | | | |
|---|---|---|---|
| 982,505 | 1/1911 | Koenig | 137/599 |
| 2,847,318 | 8/1958 | Dowlen et al. | 239/127 |
| 3,491,948 | 1/1970 | Alexander | 239/127 |
| 3,526,027 | 9/1970 | Manuel et al. | 118/317 |
| 3,702,107 | 11/1972 | Rood et al. | 118/684 |
| 3,726,711 | 4/1973 | Hogstrom . | |
| 3,778,292 | 12/1973 | Rood et al. | 118/685 |
| 3,815,544 | 6/1974 | Rood et al. | 118/685 |
| 3,921,570 | 11/1975 | Hogstrom et al. | 118/685 |
| 3,995,075 | 11/1976 | Cernauskas et al. | 118/317 |
| 4,180,011 | 12/1979 | Halicki | 118/685 |
| 4,353,326 | 10/1982 | Kolibas | 118/317 |
| 4,430,886 | 2/1984 | Rood | 73/37 |
| 4,668,948 | 5/1987 | Merkel | 239/71 |
| 4,886,013 | 12/1989 | Turner et al. | 118/668 |
| 4,932,232 | 6/1990 | Ballyns et al. | 239/74 |
| 5,296,035 | 3/1994 | Chicatelli et al. | 118/317 |
| 5,312,042 | 5/1994 | Larson | 239/124 |
| 5,316,217 | 5/1994 | Guzowski et al. | 239/71 |
| 5,537,856 | 7/1996 | Kelbrick et al. | 73/37 |

FOREIGN PATENT DOCUMENTS

| | | | |
|---|---|---|---|
| 84445 | 7/1983 | European Pat. Off. | 239/71 |
| 62-174319 | 7/1987 | Japan | 239/71 |
| 6-31216 | 2/1994 | Japan | 239/71 |
| 6-77692 | 3/1994 | Japan | 239/71 |

*Primary Examiner*—Peter Chin
*Assistant Examiner*—Michael Colaianni
*Attorney, Agent, or Firm*—Tarolli, Sundheim, Covell, Tummino & Szabo

[57] ABSTRACT

An apparatus includes a welding assembly which forms a seam in a tubular can body. A coating assembly applies coating material to an inner side surface of the seam. Coating material is conducted to the coating assembly through a main conduit. A monitor assembly, in the main conduit, includes a housing having an inlet valve and an outlet valve. An orifice is disposed within the housing between the inlet and outlet valves. A transducer senses fluid pressure downstream from the orifice. The inlet and outlet valves are operable to direct the coating material flow to and from a bypass conduit. This enables the orifice and/or the transducer to be repaired or replaced without interrupting operation of the coating assembly. In one embodiment of the invention, the monitor assembly is disposed ahead of the welding assembly and coating assembly. In another embodiment of the invention, the monitor assembly is disposed between the welding assembly and the coating assembly. A valve in a coating material return conduit may be closed during the coating of cans and be open when the coating of cans is interrupted.

42 Claims, 6 Drawing Sheets

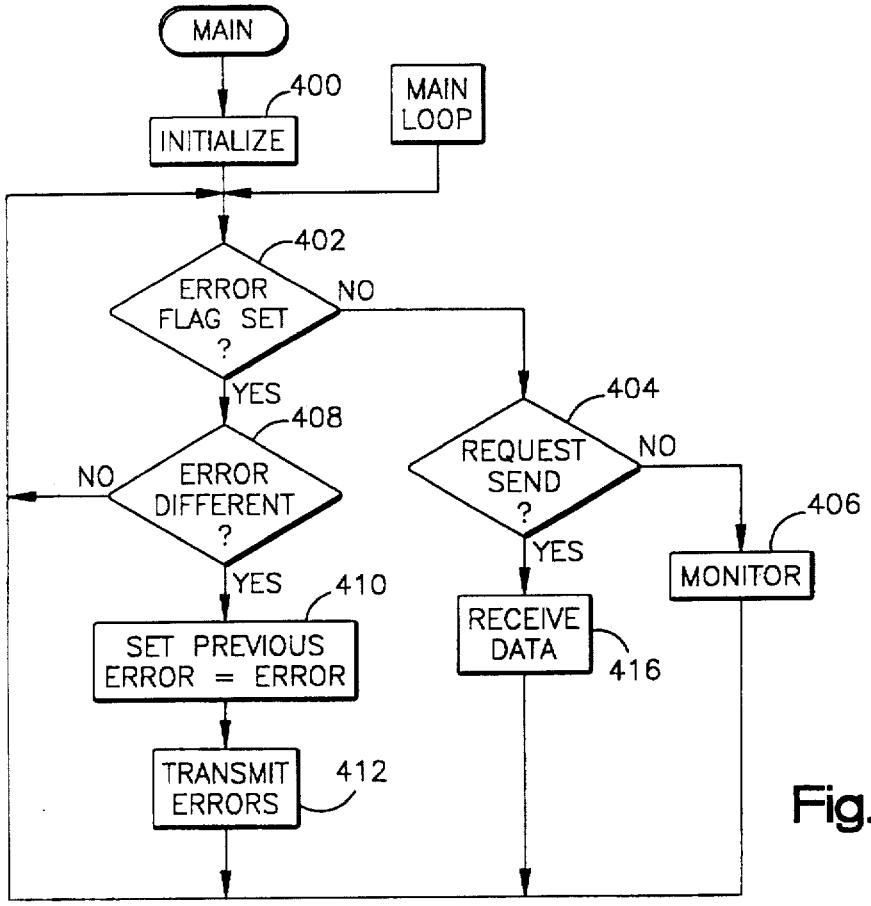
Fig.10
Fig.11
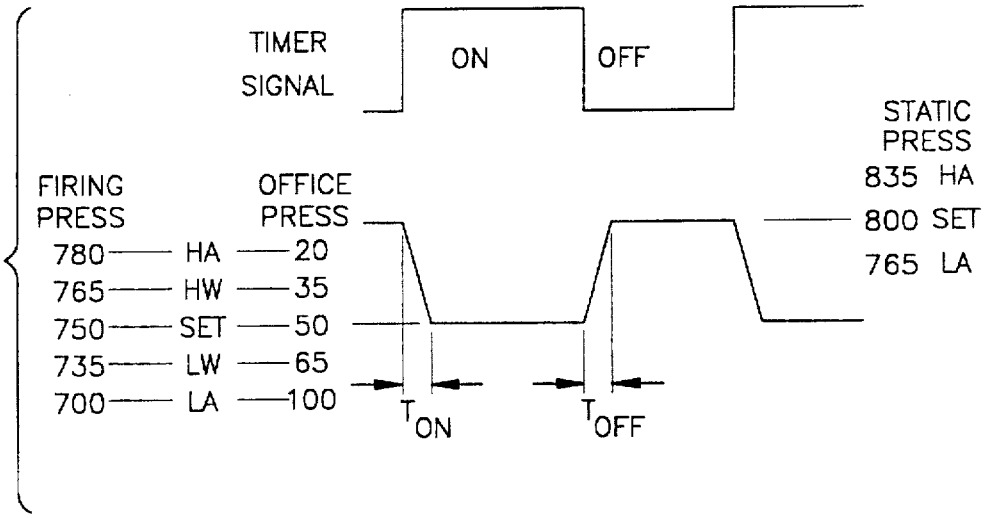

COATING ASSEMBLY WITH PRESSURE SENSING TO DETERMINE NOZZLE CONDITION

RELATED APPLICATION

This application is a continuation-in-part of U.S. patent application Ser. No. 08/632,351, filed Apr. 10, 1996 by Jeffrey M. Buckler and Harald Pleuse, and entitled "Coating Assembly With Pressure Sensing to Determine Nozzle Condition In High Speed Can Coating Operation" now abandoned. The benefit under 35 U.S.C. §120 of the aforementioned application is hereby claimed.

BACKGROUND OF THE INVENTION

The present invention relates to an apparatus for use in applying coating material to cans or similar containers.

A known apparatus for the production of cylindrical can bodies by a three-piece process is disclosed in U.S. Pat. No. 4,886,013, issued Dec. 12, 1989 and entitled "Modular Can Coating Apparatus". The apparatus disclosed in this patent includes a weld arm along which sheet metal is shaped to form tubular can bodies. In the final stages of movement of the can bodies along the weld arm, ends of the sheet metal are interconnected by a weld to form a seam. As the open-ended tubular can bodies move off the weld arm on to rails, they are pushed through a coating station. At the coating station, a stripe of protective material is sprayed over the inside of the seam in the tubular can body. From the coating station, the can body is advanced along the rails for further processing.

During operation of this known can forming apparatus, a nozzle in a spray gun which applies the stripe of protective material to the inside of the seam in the can may become clogged and/or excessively worn. When this occurs, the spray gun is ineffective to apply the coating material to the inside of the can in the desired manner. Since the apparatus forms cans at a rate of up to 700 cans per minute, it is relatively expensive to shut down the apparatus to replace a worn or clogged spray nozzle.

SUMMARY OF THE INVENTION

The present invention relates to a new and improved apparatus for applying coating material to articles. In one specific instance, the apparatus was used to apply coating material to a seam in a can. The coating material is conducted through a main conduit which is connected with a spray gun. A monitor assembly may include an orifice through which the coating material is conducted. A transducer is operable to provide an output signal indicative of variations in fluid pressure in the coating material at a location downstream of the orifice.

To facilitate repair and/or replacement of the transducer and/or the orifice, a bypass conduit may be provided to conduct a flow of coating material around the orifice. A valve may be provided to direct the flow of coating material through either the orifice or the bypass conduit.

In one embodiment of the invention, the monitor assembly is mounted between an apparatus which forms a tubular can body and a spray apparatus which applies coating material to the interior of the can body. In this embodiment of the invention, the path of movement of the can bodies is such that the monitor assembly is passed through the tubular can bodies. In another embodiment of the invention, the monitor assembly is located ahead of the apparatus which forms a can body.

A return conduit conducts excess coating material back to a source of the coating material. A return valve may be provided in the return conduit to block flow of coating material back to the source during application of coating material to can bodies. When the application of coating material to can bodies is interrupted, the return valve is opened to enable coating material to flow back to the source.

BRIEF DESCRIPTION OF THE DRAWINGS

The foregoing and other features of the invention will become more apparent upon a consideration of the following description taken in connection with the accompanying drawings, wherein:

FIG. 10 is a flow chart of a main routine executed by a data processor within the monitor control; and FIG. 11 is a timing diagram illustrating the relationship of a coating material spray gun timing signal to the pressure within the coating material spray gun.

DESCRIPTION OF SPECIFIC PREFERRED EMBODIMENTS OF THE INVENTION

General Description

Figure 1:
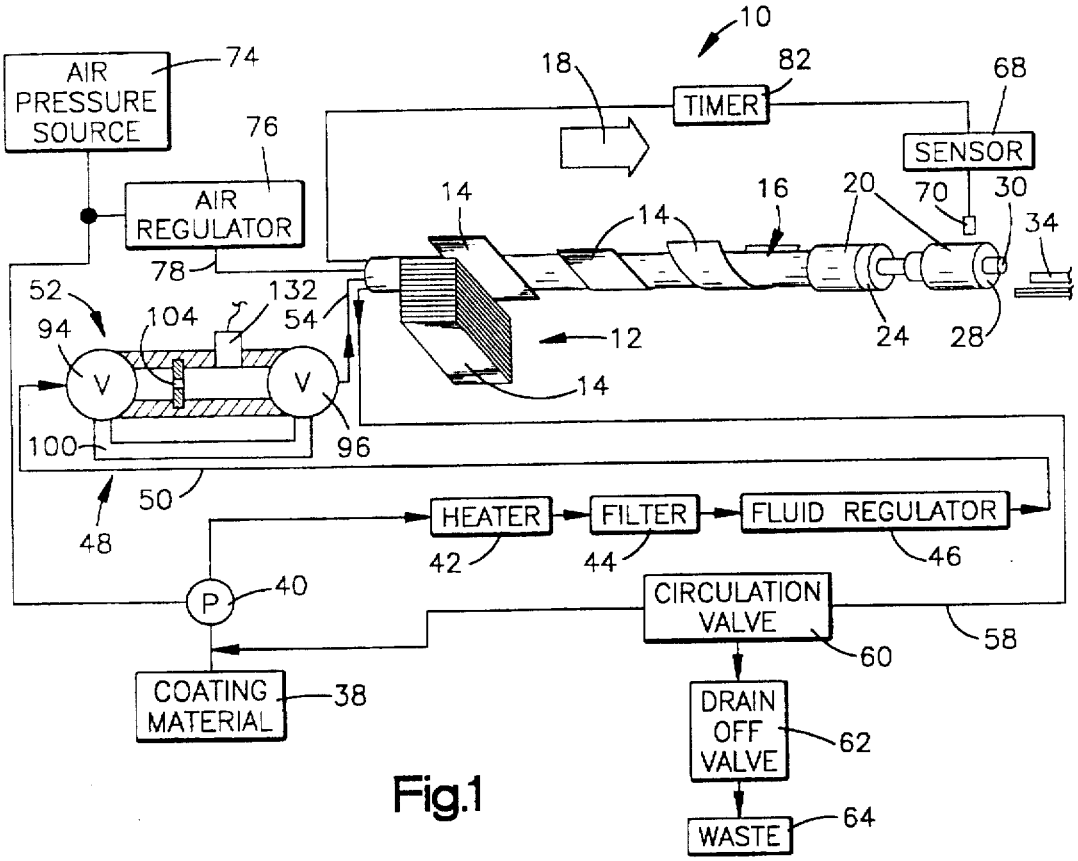
FIG. 1 is a schematic illustration of an apparatus for use in applying coating material to articles.

An apparatus 10 (FIG. 1) is operable to apply coating material to articles. In the illustrated embodiment of the invention, the apparatus 10 is used in the forming and coating of can bodies at speeds of up to approximately 700 cans per minute. The apparatus 10 includes a magazine 12 from which flat blanks 14 are sequentially fed. The blanks 14 are moved from the magazine 12 along a stationary weld arm or stub horn 16 in a direction indicated by an arrow 18.

The can blanks 14 are moved, by a suitable conveyor, along a linear path having a longitudinal central axis coincident with a longitudinal central axis of the weld arm 16. The conveyor (not shown) has lugs which engage a rear edge of the can blanks 14 and push the can blanks along the stationary weld arm 16. If desired, the conveyor could use magnets or other known devices to engage the can blanks 14 and move them along the weld arm 16. As the can blanks 14 are moved along the weld arm 16, they are bent around the weld arm. The can blanks 14 are bent from a flat configuration to a tubular cylindrical configuration in a known manner to form a cylindrical open-ended can body 20.

As an open-ended tubular can body 20 is moved along the weld arm 16, a seam forming or weld assembly 24 welds opposite edges of the blank 14 forming the tubular can body 20 together. Thus, the seam forming assembly 24 welds a can body along a straight seam which extends axially between opposite ends of the can body. If desired, opposite ends of a blank 14 forming a can body 20 could be interconnected by methods other than welding. For example, the ends of the blanks 14 could be interconnected by soldered seams or cemented seams.

A coating assembly 28 coats the inside of a seam formed in the open-ended tubular can body 20 by the weld assembly 24. The coating assembly 28 includes a spray gun 30 which directs a flow of liquid coating material toward the inside of the open-ended tubular can body 20 as the can body is moved along a linear path in the direction of the arrow 18. This results in the application of a linear axially extending stripe of coating material to the inside of the can body 20 by the stationary coating assembly 28. The stripe of coating material covers the seam and prevents exposure of the contents of a can to the metal of the seam.

The open-ended can bodies 20 to which coating material has been applied by the coating assembly 28 are moved onto rails 34. The can bodies 20 are conducted along the rails 34 to a remote location for further processing.

The coating material which is applied to the inside of an open-ended tubular can body 20 by the coating assembly 28 is pumped from a source 38 of liquid coating material by a pump 40. The flow of liquid coating material is conducted from the pump 40 through a heater 42, filter 44, and fluid regulator 46 to a main conduit 48. The main conduit 48 includes a first or upstream section 50 which conducts fluid flow from the fluid regulator 46 to a monitor assembly 52.

The monitor assembly 52 is constructed in accordance with a feature of the present invention. In the embodiment of the invention illustrated in FIG. 1, the monitor assembly 52 is disposed in the main conduit 48 at a location ahead of the weld assembly 24 and coating assembly 28. The main conduit 48 includes a second or downstream section 54 which conducts fluid flow from the monitor assembly 52 to the coating assembly 28. The second section 54 of the main conduit 48 conducts a flow of coating material along the weld arm 16 past the weld assembly 24 to the coating assembly 28. A portion of the second section 54 of the main conduit 48 is passed through the tubular can bodies 20 as the can bodies move from the weld assembly along the coating assembly 28 to the rails 34.

Excess coating material is returned from the coating assembly 28 through a return conduit 58 which is connected with a circulation valve 60. The circulation valve 60 is connected in fluid communication with the source 38 of coating material. The circulation valve 60 can be actuated to direct the return flow of coating material from the conduit 58 through a drain-off valve 62 to a waste disposal container 64.

A proximity sensor 68 (FIG. 1) has a sensor head 70 disposed adjacent to the coating assembly 28. The proximity sensor 68 detects when an open-ended tubular can body 20 moves to the coating assembly 28. In response to the output from the proximity sensor 68, a control apparatus effects actuation of a solenoid valve. The solenoid valve controls a flow of air from a fluid pressure source 74 through a pressure regulator 76 and conduit 78.

Air or fluid pressure in the conduit 78 is conducted to the coating assembly 28. The air or fluid pressure in the conduit 78 actuates a nozzle valve, that is, a coating material control valve (not shown in FIG. 1), to an open condition to enable coating material to flow from the main conduit 48 through the spray gun 30 onto the inside of the open-ended tubular can body 20. The stationary spray gun 30 applies the liquid coating material to the inside of the seam in the can body 20 as the can body moves in the direction of the arrow 18 in FIG. 1. After a predetermined time has elapsed, a timer 82 effects operation of the air flow control solenoid valve to a closed condition and the flow of coating material from the spray gun 30 is blocked.

With the exception of the monitor assembly 52, the construction and mode of operation of the apparatus 10 is the same as disclosed in the aforementioned U.S. Pat. No. 4,886,013 issued Dec. 12, 1989 and entitled "Modular Can Coating Apparatus". The disclosure in the aforementioned U.S. Pat. No. 4,886,013 is hereby incorporated herein in its entirety by this reference thereto.

The monitor assembly 52 has been illustrated in FIG. 1 as being used in association with an apparatus 10 which is used to form a three-piece can, that is, a can having a cylindrical can body 20 and two lids (not shown) which are attached to opposite ends of the can body. However, the monitor assembly 52 could be used in association with a known apparatus which is used to form a two-piece can, that is, a can in which the cylindrical can body and one end of the can are formed in one piece as a drawn cup. It is also contemplated that the monitor assembly 52 could be utilized in association with existing can spray guns.

Monitor Assembly

The monitor assembly 52 detects conditions indicative of operation of the coating assembly 28 in a manner which could result in improperly sprayed can bodies 20. The monitor assembly 52 provides an output signal which is indicative of variations in the rate of flow of coating material from the spray gun 30 onto the can bodies 20. The output signal from the monitor assembly 52 indicates when a nozzle in the spray gun 30 becomes partially clogged with a resulting reduction in the rate of flow of coating material from the spray gun. The output signal from the monitor assembly 52 also indicates when the nozzle in the spray gun 30 becomes worn with a resulting increase in the rate of flow of coating material from the spray gun. If desired, the monitor assembly 52 could be used with spray guns which apply coating material to articles other than can bodies.

Figure 2:
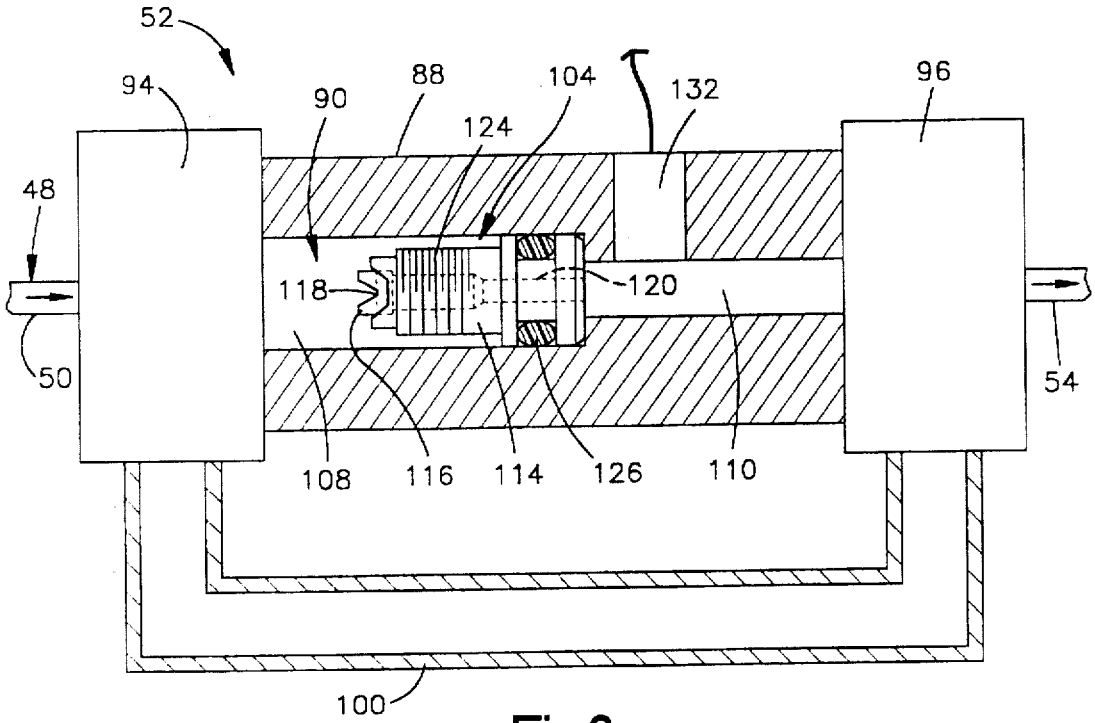
FIG. 2 is an enlarged schematic illustration of a monitor assembly disposed in the coating apparatus of FIG. 1.

The monitor assembly 52 includes a metal housing 88 (FIG. 2). The housing 88 has a central passage 90 which forms part of the main conduit 48. Coating material is conducted from the source 38 (FIG. 1) of coating material to the housing 88 through the first section 50 of the main conduit 48. Coating material is conducted through the housing 88 to the second section 54 of the main conduit 48.

The monitor assembly 52 includes a first or inlet valve assembly 94 and a second or outlet valve assembly 96 (FIG. 2). Coating material from the first section 50 of the main conduit 48 flows through the inlet valve assembly 94 into the passage 90 in the housing 88. Coating material flows from the passage 90 through the outlet valve assembly 96 to the second section 54 of the main conduit 48.

A bypass conduit 100 interconnects the inlet and outlet valve assemblies 94 and 96. The bypass conduit 100 enables coating material to be conducted directly from the inlet valve assembly 94 to the outlet valve assembly 96 without passing through the housing 88.

The inlet and outlet valve assemblies 94 and 96 are three-way valve assemblies. During normal operation of the apparatus 10, the inlet valve assembly 94 directs a flow of coating material from the first section 50 of the main conduit 48 to the passage 90. The flow of coating material is conducted from the passage 90 through the outlet valve assembly 96 to the second section 54 of the main conduit 48.

In the event that components of the monitor assembly 52 need to be repaired or replaced, the inlet and outlet valve assemblies 94 and 96 are operated to a condition directing fluid flow to the bypass conduit 100. Thus, coating material is conducted from the first section 50 of the main conduit 48 through the inlet valve assembly 94 to the bypass conduit 100. The liquid coating material flows from the bypass conduit 100 through the outlet valve assembly 96 to the second section 54 of the main conduit 48. At this time, the flow of coating material is routed around the housing 88. This enables the housing 88 and/or components of the monitor assembly 52 to be disconnected from the inlet and outlet valve assemblies 94 and 96 without interruption of operation of the spray gun 30. Since the flow of coating material to the housing 88 is blocked by the inlet and outlet valve assemblies 94 and 96, the other components of the apparatus 10 do not have to be depressurized when components of the monitor assembly 52 are repaired or replaced.

The inlet and outlet valve assemblies 94 and 96 are operable to a third or closed condition in which the valve assemblies block fluid flow through both the housing 88 and the bypass conduit 100. Thus, the inlet valve assembly 94 can be operated to a closed condition blocking fluid flow from the first section 50 of the main conduit 48. Similarly, the outlet valve assembly 96 can be operated to a closed condition blocking a flow of coating material to the second section 54 of the main conduit 48. Of course, when this is done, the supply of coating material to the coating assembly 28 is blocked and the spray gun 30 can not apply coating material to can bodies 20.

An orifice or restrictor 104 is provided in the passage 90 in the housing 88. All of the coating material which is conducted through the housing 88 flows through the monitor orifice or restrictor 104. Of course, when the inlet and outlet valve assemblies 94 and 96 are actuated to direct a flow of coating material through the bypass conduit 100, the coating material does not flow through the restrictor 104.

The restrictor 104 restricts the flow of coating material through the central passage 90. Thus, during flow of coating material through the central passage 90, the fluid pressure in an upstream portion 108 of the central passage 90 will be greater than the fluid pressure in a downstream portion 110 of the central passage 90. The fluid pressure differential between the upstream portion 108 and downstream portion 110 in the central passage 90 varies as a function of the rate of flow of coating material through the monitor orifice or restrictor 104.

At relatively low coating material flow rates through the monitor orifice 104, there will be a relatively small pressure differential between the coating material in the upstream portion 108 and the downstream portion 110 of the central passage 90. As the rate of flow of coating material through the monitor orifice 104 increases, the pressure differential between the upstream portion 108 and the downstream portion 110 of the central passage 90 will increase. Thus, as the rate of flow of coating material through the monitor orifice 104 increases, the fluid pressure in the upstream portion 108 of the central passage 90 will exceed the fluid pressure in the downstream portion 110 of the central passage by an increasing amount.

The monitor orifice or restrictor 104 has a known construction. The restrictor 104 includes a metal body 114 with a carbide insert 116 (FIG. 2). The insert 116 is mounted within the body 114. The insert provides a restricted orifice 118 through which a controlled coating material flow rate may be established. The orifice 118 has an area which is substantially smaller than the cross sectional areas of the flow passages in the first or upstream section 50 and the second or downstream section 54 of the main conduit 54.

Prior to the insert 116 being mounted within a counterbored section of a passage 120, a V-shaped diametral cut is machined into the downstream end of the insert. This V-shaped cut defines an included angle which may be approximately 60°. The V-shaped cut is ground to a depth of approximately one-half of the insert 116. After machining of this cut into the face of the insert, the insert is brazed into the counterbored section of the passage 120. The insert is oriented in the passage 120 so that the cut extends at right angles to a trapezoidal-shaped notched formed on the end of the restrictor body 70. The V-shaped cut flares outward from its apex in a direction toward the downstream portion 110 of the passage 108.

After having been brazed into the restrictor body, a second V-shaped notch is machined at right angles to the first notch. This second notch is machined to a depth at which the two notches intersect, resulting in a small restricted orifice at the point of intersection of the two notches. By careful grinding of the second notch, the diameter of the restricted orifice may be accurately controlled.

An outer end portion 124 of the body 114 is threaded. This threading of the outer end portion 124 of the body 114 enables the restrictor 104 to be attached to a tool (not shown) for insertion of the restrictor into the central passage 90 in the housing 88. An O-ring seal 126 is located within the annular groove in the body 114 of the restrictor and seals a joint between the body of the restrictor and the housing 88.

In the illustrated embodiment of the invention, the monitor orifice or restrictor 104 has the same construction as a restrictor which is disclosed in U.S. Pat. No. 4,430,886 issued Feb. 14, 1984 and entitled "Method and Apparatus for Sensing Clogged Nozzle". The disclosure in the aforementioned U.S. Pat. No. 4,430,886 is hereby incorporated herein in its entirety by this reference thereto. It should be understood that although one specific monitor orifice 104 has been illustrated in FIG. 2 and described herein, it is contemplated that the monitor orifice could have many different constructions. For example, the monitor orifice 104 could be formed by an opening in a flat plate which is mounted in the housing 88.

A pressure sensor or transducer 132 is mounted in the housing 88 and is exposed to the flow of coating material downstream from the orifice or restrictor 104. The pressure sensor or transducer 132 is operable to provide an output signal which varies as a function of variations in fluid pressure in the coating material conducted to the spray gun 30. The output signal provided by the pressure sensor or transducer 132 varies with variations in the fluid pressure in the coating material in the downstream portion 110 of the central passage 90 through the housing 88.

When the coating assembly 28 is turned off, that is, when the coating assembly is not applying coating material to a can body 20, coating fluid flow is blocked by a nozzle valve in the spray gun 30. At this time, there will be no fluid flow through the monitor orifice 104. Therefore, the fluid pressure in the portion 108 of the passage 90 upstream of the main orifice 104 will be equal to the fluid pressure in the portion 110 of the passage 90 downstream of the orifice.

When the coating assembly 28 is turned on, the nozzle valve in the spray gun 30 is opened. This enables coating material to flow from the spray gun 30 onto the interior of an open-ended tubular can body 20. As the spray gun 30 is turned on, the fluid pressure in the second section 54 of the main conduit 48 and the downstream portion 110 of the central passage 90 decreases. This decrease in fluid pressure is detected by the pressure sensor or transducer 132.

When the nozzle in the spray gun 30 is functioning properly to coat a seam inside a can body 20 in the desired manner, the fluid pressure downstream of the monitor orifice 104 will drop to a predetermined fluid pressure upon initiation of operation of the spray gun. The specific pressure to which the coating material in the downstream portion 110 of the central passage 90 drops upon initiation of operation of the spray gun 30 will vary depending upon many different factors. Among these factors are the pressure at which coating material is supplied by the pump 40, the size of the orifice 104, and the fluid flow characteristics of the coating material itself. Of course, there are many other factors which will effect the specific value of the fluid pressure sensed by the transducer 132 in the downstream portion 110 of the central passage 90 in the housing 88 upon initiation of operation of the spray gun 30.

When the spray gun 30 is functioning in a desired manner to apply coating material to the seam of an open-ended tubular can body 20, the fluid pressure detected by the transducer 132 will be a predetermined fluid pressure. During normal operation of the spray gun 30 to apply coating material in a desired manner, the fluid pressure sensed by the transducer 132 will remain substantially constant within a relatively small range. Changes in the operation of the spray gun 30 will result in a change in the fluid pressure sensed by the transducer 132.

If the nozzle in the spray gun 30 becomes partially blocked or clogged, the rate of flow of coating material through the spray gun nozzle decreases. This causes the fluid pressure in the downstream portion 110 of the passage 90 to increase. The transducer 132 will detect this increase in fluid pressure.

An electrical output signal from the transducer 132 is transmitted to a control station. At the control station, an operator can view a display screen and monitor changes in the fluid pressure detected by the transducer 132. When the fluid pressure detected by the transducer 132 increases due to a partial blocking or clogging of the nozzle in the spray gun 30, the image on the display screen is changed. This informs the operator of the increase in fluid pressure and the change in the operation of the spray gun 30.

If the nozzle in the spray gun 30 becomes excessively worn, the rate of flow of fluid through the spray gun 30 increases. This results in a decrease in the fluid pressure in the downstream portion 110 of the passage 90. The decrease in fluid pressure in the downstream portion 110 of the passage 90 is detected by the transducer 132. The electrical output signal from the transducer 132 is conducted to a display screen to inform an operator of the decrease in fluid pressure.

Although it is preferred to include the transducer 132 in the monitor assembly 52, it is contemplated that the transducer may be omitted from certain embodiments of the monitor assembly. Thus, the monitor assembly 52 may be used with existing coating systems which operate without a transducer.

It is contemplated that during continued operation of the apparatus 10 over a relatively long period of time, the restrictor 104 and/or the transducer 132 may malfunction. For example, the restrictor 104 may become partially blocked or a sensor device in the transducer 132 may fail to function in the desired manner.

When this occurs, the inlet and outlet valve assemblies 94 and 96 are operated to direct fluid flow from the first section 50 of the main conduit 48 through the bypass conduit 100 to the second section 54 of the main conduit without being conducted through the housing 88. This allows the spray gun 30 to continue functioning while the restrictor 104 and/or transducer 132 are repaired or replaced. Since cans are coated at a rate of approximately 500 to 700 per minute, even a short interruption in the operation of the spray gun 30 should be avoided if possible.

It is contemplated that the monitor assembly 52 will facilitate cleaning of the coating assembly 28. When the coating assembly is to be cleaned, the inlet and outlet valve assemblies 94 and 96 are actuated to direct a flow of cleaning fluid around the orifice 104. This enables the flow of cleaning fluid to be conducted through the components of the coating apparatus 28 without being conducted through the restrictor 104.

It is also contemplated that the control assembly 52 will facilitate bleeding air out of the coating assembly 28. When air is to be bled out of the coating assembly 28, the inlet and outlet valve assemblies 94 and 96 are actuated to direct a flow of air purging liquid around the orifice 104. This enables the flow of air purging liquid to be conducted through the components of the coating apparatus 28 without being conducted through the restrictor 104.

Second Embodiment

Figure 3:
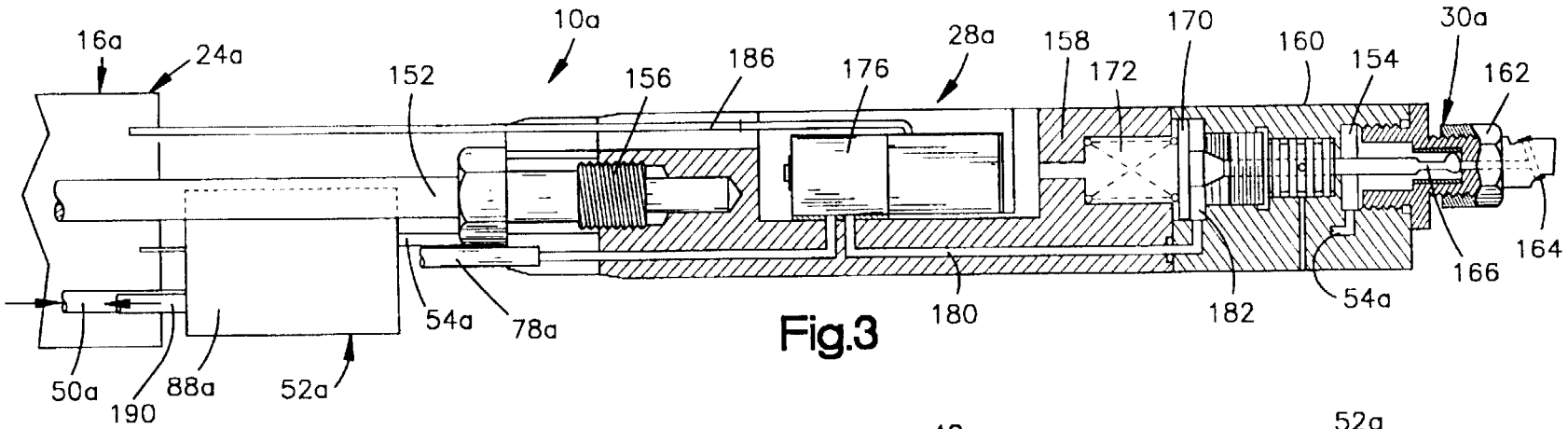
FIG. 3 is an enlarged schematic illustration of a second embodiment of the coating apparatus.
Figure 5:
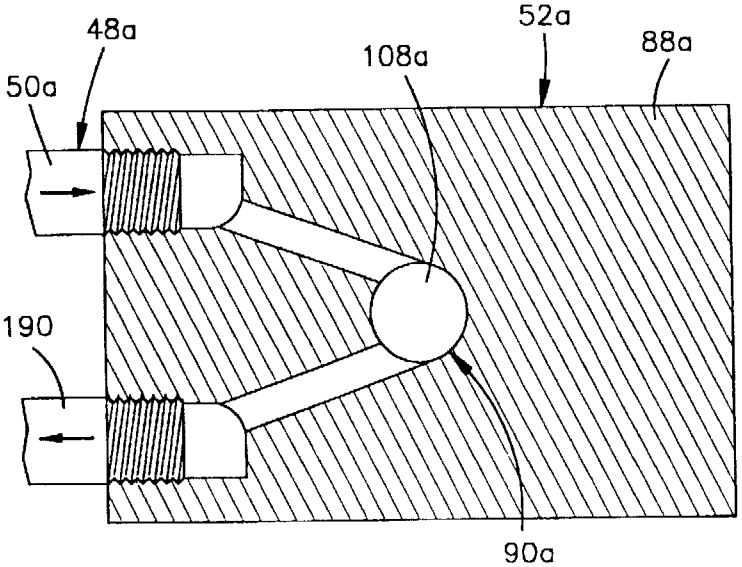
FIG. 5 is a sectional view, taken generally along the line 5—5 of FIG. 4.
Figure 4:
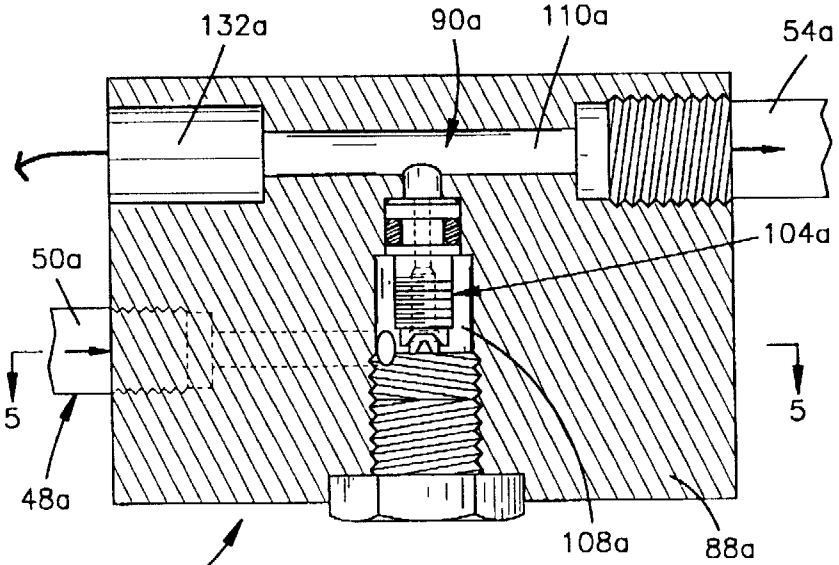
FIG. 4 is an enlarged sectional view of a monitor assembly disposed in the coating apparatus of FIG. 3.

In the embodiment of the invention illustrated in FIGS. 1 and 2, the monitor assembly 52 is disposed ahead of the weld arm 16 and is spaced from the weld assembly 24 and coating assembly 28. In the embodiment of the invention illustrated in FIGS. 3–5, the monitor assembly 52 is disposed between the weld assembly 24 and the coating assembly 28 along the linear path of movement of the can bodies 20. Since the embodiment of the invention illustrated in FIGS. 3–5 is generally similar to the embodiment of the invention illustrated in FIGS. 1 and 2, similar numerals will be utilized to designate similar components, the suffix letter "a" being associated with the numerals of FIGS. 3–5 to avoid confusion.

An apparatus **10*a* (FIG. 3) for forming and coating can bodies includes a weld arm 16*a* on which a seam forming or welding assembly 24*a* is disposed. A coating assembly 28*a* having a spray gun 30*a* is connected with the weld arm 16*a* by a mounting rod 152. A monitor assembly 52*a*, constructed in accordance with the present invention, is secured to the mounting rod 152. During movement of the tubular can bodies between the weld arm 16*a* and coating assembly 28*a*, each of the can bodies briefly encloses the monitor assembly 52*a***.

It is contemplated that a strap could be used to connect the monitor assembly **52*a* with the mounting rod 152. Alternatively, a clamp and/or threaded fasteners could be utilized to connect the monitor assembly 52*a* with the mounting rod 152**.

The spray gun **30*a* is supplied with coating material by a main conduit 48*a*. The main conduit 48*a* includes a first section 50*a* which conducts a flow of liquid coating material to the control assembly 52*a*. The main conduit 48*a* also includes a second section 54*a* which conducts a flow of liquid coating material from the control assembly 52*a* to a chamber 154 (FIG. 3) in the spray gun 30*a***.

The coating assembly **28*a* (FIG. 3) includes a connector assembly 156 which connects the mounting rod 152 with a body or fluid manifold section 158 of the coating assembly. The manifold section 158 is connected with a spray gun 30*a*. Thus, the spray gun 30*a* has a body 160 which is secured to a downstream end of the manifold section 158. The second section 54*a* of the main conduit 48*a* extends through the manifold section 158 into the spray gun body 160**.

The spray gun **30*a* includes a fluid spray tip 162 having a spray orifice 164 through which a flow of coating material from the second section 54a of the main conduit 48a is directed toward the seam on the inside of a tubular can body. A nozzle valve 166 is movable relative to the fluid spray tip 162 and has a well known needle type construction. When the nozzle valve 166 is in the illustrated closed position, the flow of coating material from the chamber 154 through the fluid spray tip 162 and spray orifice 164 is blocked. Upon movement of the nozzle valve 166 toward the left (as viewed in FIG. 3) to an open position, coating material can flow from the chamber 154 through the spray tip 162 and spray orifice 164**.

A piston 170 is connected with the nozzle valve 166. The piston 170 is movable against the influence of a spring 172 to actuate the nozzle valve 166 from the closed condition to an open condition.

An electrical solenoid valve 176 is connected with a source of fluid (air) pressure through a conduit 78a. When the electrical solenoid valve 176 is in an open condition, fluid flows from the conduit 78a through the electrical solenoid valve 176 to a conduit 180. The conduit 180 is connected with a piston chamber 182. Therefore, upon operation of the electrical solenoid valve 176 to an open condition, fluid (air) pressure is conducted through the conduits 78a and 180 to the piston chamber 182.

Fluid pressure conducted to the piston chamber 182 causes the piston 170 to move toward the left (as viewed in FIG. 3). This movement of the piston 170 moves the nozzle valve 166 to the open condition to enable liquid coating material to flow from the spray orifice 164. The electrical solenoid valve 176 is energized by electrical energy conducted over electrical lines 186.

The general construction and mode of operation of the coating assembly 28a (FIG. 3) is the same as is disclosed in the aforementioned U.S. Pat. No. 4,886,013. The coating assembly 28 of FIG. 1 has the same construction as the coating assembly 28a of FIG. 3. However, the apparatus 10a of FIG. 3 has the monitor assembly 52a mounted between the weld arm 16a and coating assembly 28a. Since the monitor assembly 52a is disposed very close to the fluid spray tip 162 (FIG. 3), the length of the conduit 54a through which the fluid pressure is conducted from the spray tip to the monitor assembly is minimized. This minimizes any tendency for changes in the fluid pressure to be dampened or absorbed with changes in operating conditions at the spray tip 162.

The monitor assembly 52a includes a housing 88a (FIG. 4) which is disposed between the weld arm 16a (FIG. 3) and the coating assembly 28a. The monitor assembly 52a is connected with a source of coating material by a first section 50a of the main conduit 48a. The coating material flows through the housing 88a to the second section 54a of the main conduit.

When the nozzle valve 166 (FIG. 3) is in the closed condition blocking fluid flow through the spray gun 30a, the coating material is conducted from the housing 88a through a return conduit 190 (FIG. 5). The first section 50a of the main conduit 48a is connected with an upstream portion 108a (FIGS. 4 and 5) of a central passage 90a in the housing 88a. The return conduit 190 is also connected with the upstream portion 108a of the central passage 90a. Excess coating material is conducted from the central passage 90a through the return conduit 190 back to the source of coating material.

The flow of coating material through the return conduit 190 (FIG. 5) is restricted, compared to the flow of coating material through the first section 50a of the main conduit 48a. Therefore, a predetermined minimum fluid pressure is maintained in the upstream portion 108 of the central passage 90a when the needle valve 166 (FIG. 3) is in the open position. When the needle valve 166 is in the open position, the spray gun 30a is effective to direct a flow of liquid coating material toward the inside of a can body through the spray orifice 164.

During operation of the spray gun 30a, the flow of liquid coating material, conducted from the first section 50a (FIG. 4) to the second section 54a of the main conduit 48a, passes through a control orifice or restrictor 104a. Thus, coating material flows through the restrictor 104a from the upstream portion 108a of the central passage 90a to the downstream portion 110a of the central passage. The restrictor 104a has the same construction as the restrictor 104 of FIG. 2.

A transducer or sensor 132a (FIG. 4) is exposed to the fluid pressure downstream of the control orifice 104a. The transducer 132a is operable to provide an electrical output signal which varies as a function of variations in fluid pressure in coating material conducted through the main conduit 48a to the fluid spray tip 162 of the spray gun 30a.

When the nozzle valve 166 is in the closed condition illustrated in FIG. 3, fluid flow from the chamber 154 through the spray tip 162 of the spray gun 30a is blocked. At this time, there is a relatively high fluid pressure in the downstream portion 110a of the central passage 90a through the housing 88a.

When the spray gun 30a is to be activated to apply a stripe of coating material to the inside of a seam in an open-ended tubular can body, the electrical solenoid valve 176 (FIG. 3) is energized over the leads 186. This results in the electrical solenoid valve 176 being actuated to an open condition in which fluid (air) pressure is conducted from the conduit 78a through the electrical solenoid valve 176 to the conduit 180 and piston chamber 182. The fluid pressure in the piston chamber 182 moves the piston 170 toward the left (as viewed in FIG. 3) to move the nozzle valve 166 to an open condition.

Upon operation of the nozzle valve 166 to an open condition, coating material conducted through the second section 54a of the main conduit 48a flows from the spray orifice 164 in the fluid spray tip 162 (FIG. 3) onto an inner side surface of the seam in the open-ended tubular can body. When the fluid spray tip 162 is functioning properly to coat a seam inside a can in the desired manner, the fluid pressure downstream from the control orifice 104a (FIG. 4) will drop to a predetermined pressure. This predetermined pressure will be sensed by the transducer 132a.

If the orifice 164 in the fluid spray tip 162 becomes partially blocked or clogged, the fluid pressure downstream of the control orifice 104a will be greater than the predetermined pressure during the application of coating material to the inside of a can by the spray gun 30a. The increased fluid pressure will be sensed by the transducer 132a. A display screen connected with the transducer 132a will inform an operator that the fluid pressure downstream from the control orifice 104a is greater than the normal fluid pressure. This will alert the operator to the abnormal condition of the spray orifice 164.

If the spray orifice 164 in the fluid spray tip 162 becomes worn, the fluid pressure downstream from the control orifice 104a will be less than the predetermined or normal fluid pressure. This relatively low fluid pressure is detected by the transducer 132a. An output signal from the transducer 132a is conducted to a display screen to inform an operator of the relatively low fluid pressure downstream from the orifice 104a. This enables the operator to respond quickly to the abnormal operating condition at the orifice 164 of the spray gun 30a.

Since the monitor assembly 52a is mounted between the weld arm 16a and the coating assembly 28a, the monitor assembly is disposed along the path of movement of the open-ended tubular can bodies. This results in the stationary monitor assembly 52a being briefly enclosed by each of the can bodies in turn as the can bodies move along a linear path from the weld arm 16a to the coating assembly 28a and from the coating assembly to a receiving location, such as the rails 34 of FIG. 1. Thus, the stationary monitor assembly 52a passes through each of the tubular can bodies in turn during movement of the tubular can bodies along the weld arm 16a and coating assembly 28a.

If desired, the return conduit 190 could be connected with the chamber 154 in the spray gun 30a. If this was done, the return flow of coating material would not have to be conducted through the housing 88a. It is contemplated that a heater may be provided to heat the coating material in the coating assembly 28a.

Third Embodiment

Figure 6:
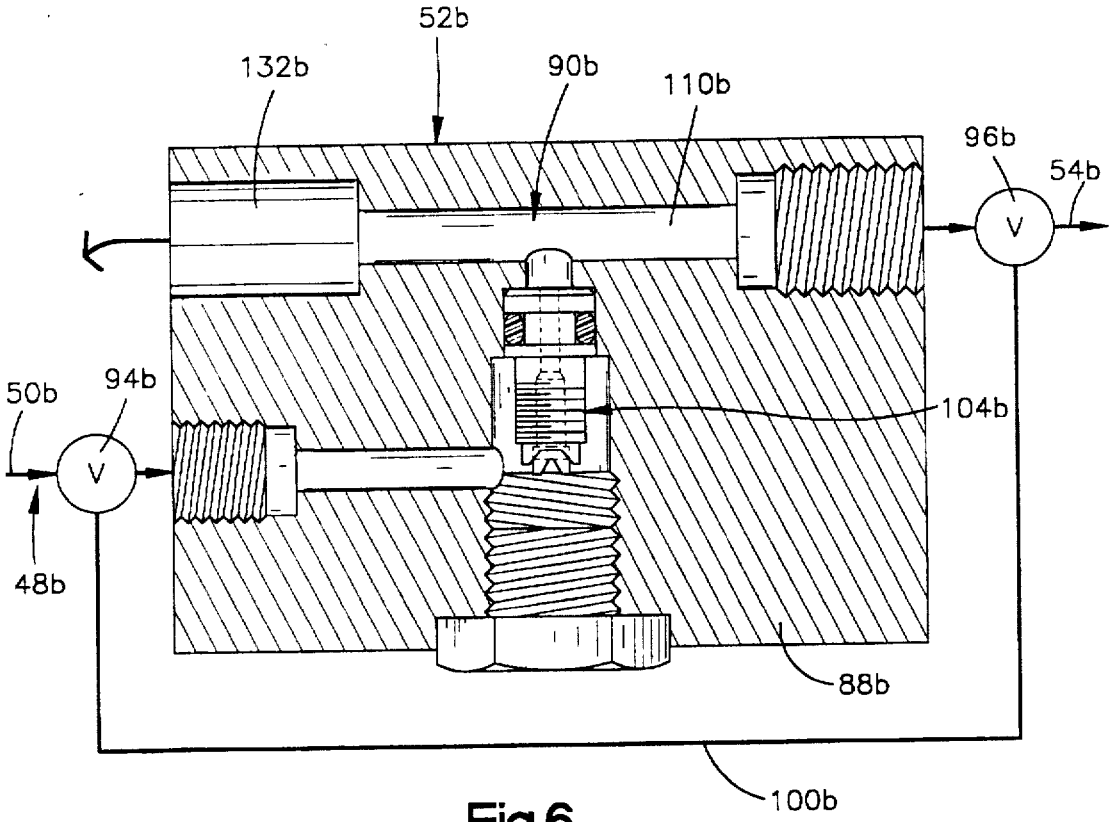
FIG. 6 is a fragmentary sectional view of a third embodiment of the monitor assembly of FIG. 4.

In the embodiment of the invention illustrated in FIGS. 3–5, a bypass conduit, corresponding to the bypass conduit 100 of FIG. 2, is not associated with the control assembly 52a. The elimination of the bypass conduit facilitates mounting of the monitor assembly 52a in the restricted space between the weld arm 16a and coating assembly 28a. However, in the embodiment of the invention illustrated in FIG. 6, a bypass conduit is associated with the monitor assembly even though the monitor assembly is mounted between the weld arm 16a and coating assembly 28a. Since the embodiment of the invention illustrated in FIG. 6 is generally similar to the embodiments of the invention illustrated in FIGS. 1–5, similar numerals will be utilized to designate similar components, the suffix letter "b" being associated with the numerals of FIG. 6 in order to avoid confusion.

A stationary monitor assembly 52b (FIG. 6) is mounted between the weld arm and coating assembly in the same manner as is illustrated for the monitor assembly 52a of FIG. 3. The monitor assembly 52b includes a housing 88b having a central passage 90b in which a restrictor or monitor orifice 104b is disposed. A transducer 132b detects the fluid pressure in a downstream portion 110b of the central passage 90b.

In accordance with a feature of this embodiment of the invention, a bypass passage 100b is connected with the main conduit 48b by a first or inlet valve assembly 94b and a second or outlet valve assembly 96b. The valves 94b and 96b are three-way valves and function in the same manner as do the valves 94 and 96 of the embodiment of the invention illustrated in FIGS. 1 and 2. Thus, during normal operation of the coating assembly, liquid coating material is conducted from a first section 50b of the main conduit 48b through the inlet valve assembly 94b to the central passage 90b in the housing 88b. This coating material flows through the restrictor 104b to the downstream portion 110b of the central passage 90b. The coating material flows from the downstream portion 10b of the central passage 90b through the outlet valve assembly 96b to the second section 54b of the main conduit 48b.

If for any reason the monitor orifice 104b and/or transducer 132b should malfunction, the inlet valve assembly 94b and the outlet valve assembly 96b are actuated to direct fluid flow from the first section 50b of the main conduit 48b to the bypass passage 100b. The coating material flows from the bypass passage 100b through the outlet valve assembly 96b to the second section 54b of the main conduit 48b. The restrictor 104b has the same construction as the restrictor 104 of FIG. 2.

During movement of the open-ended tubular can bodies along the welding assembly and coating assembly, the monitor assembly 52b passes through each of the tubular can bodies in turn. This means that the housing 88b, bypass conduit 100b and valve assemblies 94b and 96b must form a compact unit which can pass easily through the tubular can bodies.

Although the bypass conduit 100b has been shown as being separate from the housing 88b, it is contemplated that it may be desired to have the bypass conduit 100b within the housing 88b. When the bypass conduit 100b is disposed within the housing 88b, the space required for the monitor assembly 52b is reduced. However, having the bypass passage 100b in the housing 88b could complicate repair and/or replacement of the control orifice 104b and transducer 132b.

In the embodiment of the invention illustrated in FIGS. 1 and 2, it is preferred to have the bypass passage 100 outside of the housing 88 since the monitor assembly 52 is not mounted in the restricted space between the welding assembly 24 and coating assembly 28. However, in the embodiment of the invention illustrated in FIGS. 3–6, the monitor assembly 52b is mounted in the restricted space between the welding assembly 24a and coating assembly 28a (FIG. 3). Therefore, it may be preferred, particularly in the embodiments of the invention illustrated in FIGS. 3–6, to have the bypass passage 100b disposed within the housing 88b.

Fourth Embodiment

Figure 7:
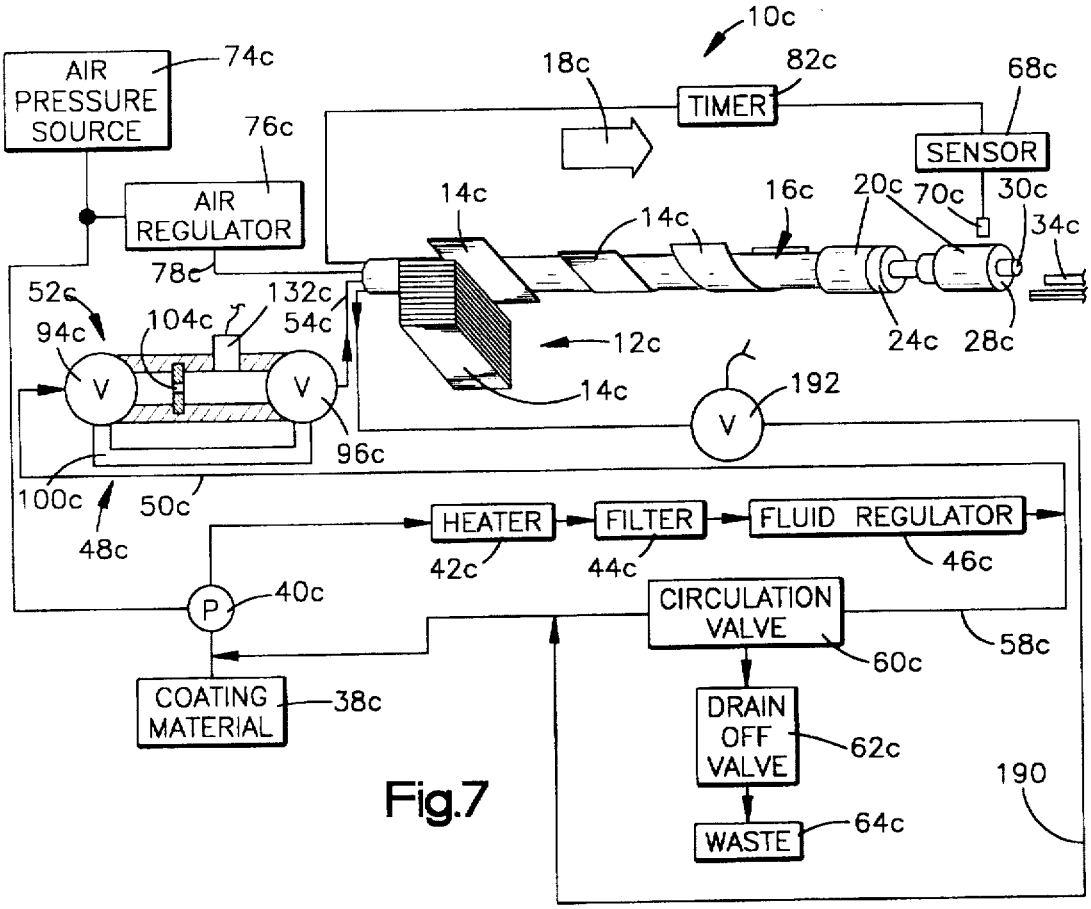
FIG. 7 is a schematic illustration, generally similar to FIG. 1, of another embodiment of the apparatus for use in applying coating material to articles.

In the embodiment illustrated in FIGS. 1–6, excess coating material is continuously returned to its source 38 (FIG. 1) of coating material through the return conduit 58. When the apparatus 10 is operated to apply coating material to articles at relatively low coating material flow rates, the restrictor 104 must be relatively small to achieve the desired pressure drop with the low coating material flow rate. At these low coating material flow rates, the flow of coating material through the return conduit 58 may tend to be detrimental to proper operation of the coating assembly 28. In the embodiment of the invention illustrated in FIG. 7, a return valve is provided in the return conduit to block the flow of coating material through the return conduit during the application of coating material to an article. Since the embodiment of the invention illustrated in FIG. 7 is generally similar to the embodiment of the invention illustrated in FIGS. 1 and 2, similar numerals will be utilized to identify similar components, the suffix letter "c" being associated with the numerals of FIG. 7 in order to avoid confusion.

The apparatus 10c (FIG. 7) is advantageously used to apply coating material to articles at relatively low coating material flow rates. The relatively low coating material flow rates may be the result of the coating of fewer number of articles within a period of time or the result of applying less coating material to each of the articles. If desired, the apparatus 10c could also be utilized to apply coating material to articles at relatively high coating material flow rates.

The apparatus 10c includes a magazine 12c from which flat blanks 14c are sequentially fed. The blanks 14c are moved from the magazine 12c along a stationary weld arm or stub horn 16c in a direction indicated by an arrow 18c. As the can blanks 14c are moved along the weld arm 16c they are bent around the weld arm. A seam forming or weld assembly 24c welds opposite edges of each can blank 14c in turn together to form a tubular can body 20c.

A coating assembly 28c coats the inside of a seam formed in the open-ended tubular can body 20c by the weld assembly 24c. The coating assembly 28c includes a spray gun 30c which directs a flow of liquid coating material toward the inside of the open-ended tubular can body 20c. The open-ended can-bodies 20c to which coating material has been applied by the coating material assembly 28c are moved onto rails 34c and are moved to a remote location for further processing.

The coating material is pumped from a source 38c of liquid coating material by a pump 40c. The flow of coating material is conducted from the pump 40c to a heater 42c, filter 44c, and fluid regulator 46c to a main conduit 48c. In addition, coating material is returned to the source 38c of coating material through a return conduit 58c and recirculation valve 60c.

The main conduit 48c includes a first section 50c which conducts fluid flow from the fluid regulator 46c to a monitor assembly 52c. The main conduit 48c includes a second or downstream section 54c which conducts fluid flow from the monitor assembly 52c to the coating assembly 28c. Excess coating material is returned from the coating assembly 28c to the source 38c of coating material through a return conduit 190. The circulation valve 60c can be actuated to direct the return flow of coating material from the conduit 58c through a drain-off valve 62c to a waste disposal container 64c.

A proximity sensor 68c has a sensor head 70c disposed adjacent to the coating assembly 28c. In response to the output to the proximity sensor 68c, a control apparatus effects operation of a solenoid valve. The solenoid valve controls a flow of air from a fluid pressure source 74c through a pressure regulator 76c and conduit 78c. A timer 82c effects operation of the air flow control solenoid valve to a closed condition after coating material has been applied to a seam in a can body 20 for a predetermined length of time.

The monitor assembly 52c has the same construction as the monitor assembly 52 illustrated in FIGS. 1 and 2. The monitor assembly 52c includes a first or inlet valve assembly 94c and a second or outlet valve assembly 96c (FIG. 7). A bypass conduit 100c interconnects the inlet and outlet valve assemblies 94c and 96c. The inlet and outlet valve assemblies are three-way valve assemblies. During normal operation of the apparatus 10c, the valve assembly 94c directs the flow of coating material toward an orifice or restrictor 104c. The flow of coating material conducted through the restrictor 104c is conducted through the outlet valve assembly 96c to the coating assembly 28c.

A pressure sensor or transducer 132c is exposed to the flow of coating material downstream from the orifice or restrictor 104c. The pressure sensor or transducer 132c is operable to provide an output signal which varies as a function of variations in fluid pressure in the coating material conducted to the spray gun 30c.

In accordance with a feature of this embodiment of the invention, a return valve 192 is provided in the return line 58c. Although the return valve 192 has been illustrated in FIG. 7 as being spaced from the spray gun 30c, the return valve could be relatively close to the spray gun if desired. Thus, the return valve 192 could be disposed in the weld arm 16c if desired.

During normal operation of the apparatus 10c to apply coating material to articles such as can bodies 20c, a suitable controller maintains the return valve 192 in a closed condition blocking fluid flow through the return conduit 58c. Therefore, all of the coating material which flows through the orifice 104c is conducted through the second section 54c of the main conduit 48c to the spray gun 30c and is applied to can bodies 20c.

It is contemplated that the apparatus 10c may occasionally be shut down for a period of time. After the apparatus 10c has been shut down for a predetermined length of time, for example, three minutes, the controller effects operation of the return valve 192 from the closed condition to the open condition. This enables a flow of coating material to be established from the second section 54c of the main conduit 48c through the return valve 192 and return conduit 58c to the source 38c of coating material. The flow of coating material through the return conduit 58c is effective to maintain the coating material in the apparatus 10c at a desired operating temperature while the apparatus is inactive.

When can coating operations are to again be undertaken, the return valve 192 is operated from an open condition enabling coating material to flow through the return conduit 58c to a closed condition blocking flow of coating material through the return conduit. Immediately after operation of the return valve 192 to the closed condition, operation of the spray gun 30c to apply coating material to the can bodies 20c is initiated. Since the return valve 192 is in the closed condition blocking the flow of coating material through the return conduit 58c, the entire flow of coating material through the orifice 104c is available for application to can bodies 20c. Since flow through the return conduit 58c is blocked, there is no pressure loss at the spray gun 30c due to the flow of coating material into the return conduit 58c.

Although it may be preferred to have the return valve 192 actuated between the open and closed conditions by a suitable controller, the return valve may be manually actuated if desired. Although the return valve 192 is particularly advantageous when used in association with low speed or low coating material flow systems, it is contemplated that the return valve will be advantageously used in association with high speed or high coating material flow rate systems. The use of the return valve 192 with high speed or high coating material flow rate systems tends to improve the output from the transducer 132c.

Fifth Embodiment

Figure 8:
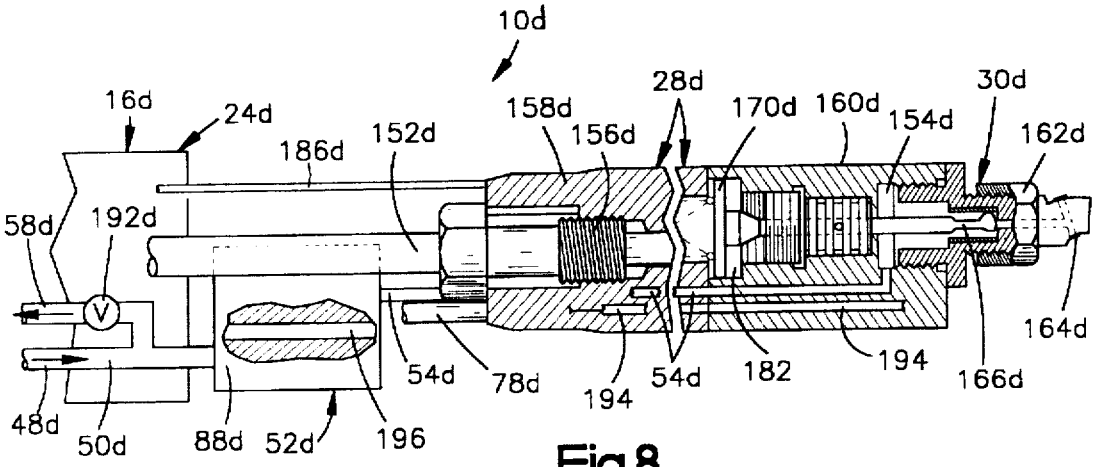
FIG. 8 is a fragmentary schematic illustration, generally similar to FIG. 3, of another embodiment of the coating apparatus.

In the embodiment of the invention illustrated in FIG. 7, the monitor assembly 52c and return valve 192 are spaced from the weld assembly 24c and coating assembly 28c. In the embodiment of the invention illustrated in FIG. 8, the monitor assembly and the return valve are disposed along the linear path of movement of the can bodies and are relatively close to the weld assembly and coating assembly. Since the embodiment of the invention illustrated in FIG. 8 is generally to the embodiment of the invention illustrated in FIG. 7, similar numerals will be utilized to designate similar components, the suffix letter "d" being associated with the numerals of FIG. 8 to avoid confusion.

An apparatus 10d (FIG. 8) for forming and coating can bodies includes a weld arm 16d on which a seam forming or welding assembly 24d is disposed. A coating assembly 28d having a spray gun 30d is connected with the weld arm 16d by a mounting rod 152d. A monitor assembly 52d, having the same construction as the monitor assembly 52a of FIGS. 3–5, is secured to the mounting rod 152d. During movement of tubular can bodies between the weld arm 16d and coating assembly 28d, each of the can bodies briefly encloses the monitor assembly 52d. In addition, the return valve 192d and a portion of the return conduit 58d is briefly enclosed by each of the can bodies in turn. The return valve 192d is optional and may be deleted if desired.

The spray gun 30d is supplied with coating material through the main conduit 48d. The main conduit 48d includes a first section 50d which conducts a flow of liquid coating material to the control assembly 52d. The main conduit 48d also includes a second section 54d which conducts a flow of liquid coating material from the coating assembly 52d to a chamber 154d in the spray gun 30d. Thus, the second section 54d of the main conduit 48d extends from the housing 88d through the body 160d of the connector assembly 156d to the chamber 154d in the spray gun 30d.

A connector assembly 156d connects the mounting rod 152d with a body of fluid manifold section 158d of the coating assembly. The manifold section 158d is connected with the spray gun 30d.

The spray gun 30d includes a fluid spray tip 162d having a spray orifice 164d through which a flow of coating material from the second section 54d of the main conduit 48d is directed toward the seam on the inside of a tubular can body. A nozzle valve 166d is movable relative to the spray tip 162d and has a well known needle-type construction. When the nozzle valve 162d is in the illustrated closed position, the flow of coating material from the chamber 154d through the fluid spray tip 162d and spray orifice 164d is blocked. Upon movement of the nozzle valve 166d toward the left (as viewed in FIG. 8) to an open position, coating material can flow from the chamber 154d through the spray tip 162d and spray orifice 164d.

A piston 170d is disposed in a piston chamber 182 and is connected with the nozzle valve 166d. The piston 170d is movable against the influence of a suitable spring to actuate the nozzle valve 166d from the closed condition to an open condition. An electrical solenoid valve (not shown) is connected with a source of fluid (air) pressure through a conduit 78d. When the electrical solenoid valve is in the open condition, fluid (air) pressure is conducted to the piston chamber 182 to actuate the nozzle valve 166d. The electrical solenoid valve is energized by electrical energy conducted over electrical lines 186d.

The monitor assembly 52d has the same general construction as the monitor assembly 52a of FIGS. 4 and 5. Thus, the monitor assembly 88d has an orifice, corresponding to the orifice 104a of FIG. 4, through which the coating material passes. A transducer or sensor, corresponding to the transducer 132a of FIG. 4, is disposed downstream of the orifice in the monitor assembly 52d. In the embodiment of the invention illustrated in FIG. 8, the housing 88d of the monitor assembly 52d is not connected with the return conduit 58d in the manner in which the housing 88a (FIG. 5) of the monitor assembly 52a is connected with the return conduit 190. Of course, the return conduit 58d (FIG. 8) could be connected with the housing 88d of the monitor assembly 52d if desired.

Control Apparatus

Figure 9:
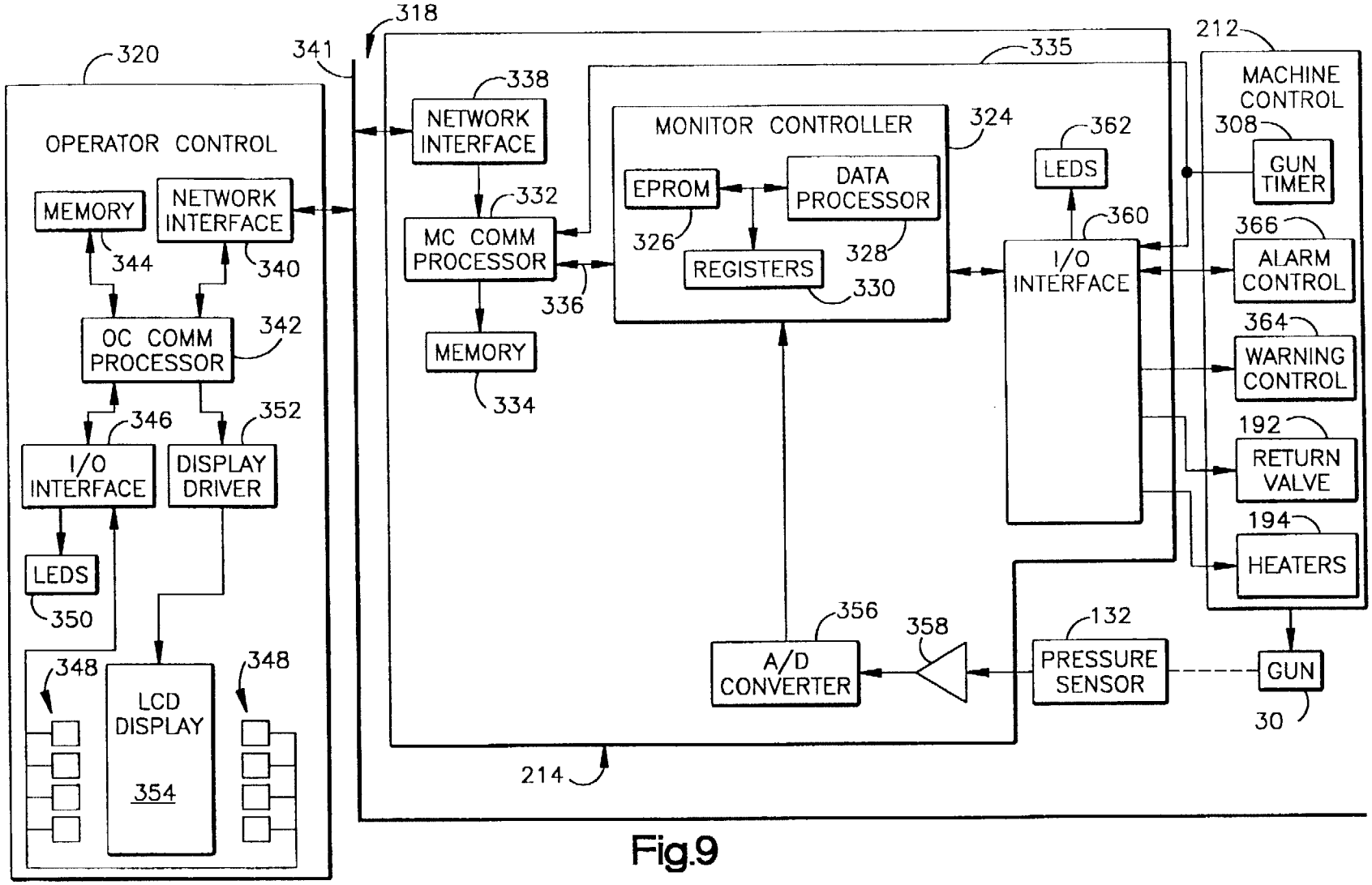
FIG. 9 is a schematic block diagram of a monitor control and associated operator control.

Referring to FIG. 9, a machine control 212 provides ON and OFF signals to the spray gun 30 which turns the spray gun (FIG. 1) on. When the spray gun 30 is turned on, coating material flows through the orifice 104. If the flow related parameters, for example, the static pressure, the condition of the control valve, the gun orifice size, etc. are within specification, the calibrated orifice 104 provides a small pressure drop thereacross, preferably at least 50 pounds per square inch ("psi"). Therefore, the pressure in the downstream portion 110 of the passage 90 (FIG. 2), which is measured by the pressure sensor or transducer 132 is equal to the static supply or regulated static pressure less the pressure drop across the calibrated orifice; and that measured pressure will change as a function of changes in coating material flow related parameters. Thereafter, the fluid is conducted through the spray gun 30 to apply coating material to the seam of an open ended tubular can body.

When the gun is turned ON, the measured pressure within the downstream portion 110 of the passage 90 is, for purposes of this application, referred to as the "firing pressure". The firing pressure is sensed by the transducer 132. Under normal flow conditions and given a static pressure of, for example, 800 psi, the calibrated orifice will produce a firing pressure drop of at least 50 psi; and therefore, a normal firing pressure would be approximately 750 psi.

When the spray gun 30 is activated, if the nozzle of the spray gun is clogged and flow through the nozzle is diminished, the firing pressure will be higher than normal and the pressure drop will be less. This higher firing pressure value is transmitted from the transducer or pressure sensor 132 to a fluid dispensing monitor 214 (FIG. 9). The higher firing pressure value is detected by the fluid dispensing monitor 214. Similarly, as the spray gun nozzle becomes worn and the fluid flow therethrough increases, the firing pressure decreases; and the pressure drop across the orifice 104 increases. The reduced firing pressure is detected by the fluid dispensing monitor 214. In addition, when the gun 30 is turned OFF, the pressure within the downstream portion 110 of the passage 90 is expected to be approximately equal to the static pressure of the coating material being supplied to the gun 30. Variations from expected pressures at the output of the orifice 104 are detected by the transducer 132 and are analyzed by the fluid dispensing monitor 214. The fluid dispensing monitor 214 provides fluid flow condition signals and data as a function of the detected changes in the fluid pressure in the downstream portion 110 of the passage 90 which reflected variations in the fluid flow conditions through the spray gun 30.

The machine control 212 includes a timing device such as a gun timer 308 (FIG. 9). In response to signals from the sensors indicating the presence of a can to be sprayed, the gun timer 308 provides a timing signal to turn the spray gun ON thereby dispensing fluid therefrom and coating a can. After a predetermined period of time, the gun timer 308 within the machine control 212 change the state of the timing signals to turn the gun 30 OFF.

During the time when the gun is turned ON and OFF, the pressure transducer 132 continuously measures the pressure between the orifice 104 and the nozzle in the spray gun 30. Monitor controls 214 are associated with but located remotely from spray gun 30. For example, the monitor control 214 may be located anywhere from several inches to 100 feet away from the spray gun 30. The monitor control 214 is connected to a communication network 318 and transmit and receive data from one or more operator controls 320.

If the spray gun 30 is turned off for a predetermined period of time, for example three minutes, the machine control 212 actuates the return valve 192 (FIG. 7) or 192d (FIG. 8) to an open condition. If the spray gun is provided with heaters, corresponding to heaters 194 and 196 of FIG. 8, the machine control 212 will energize the heaters. Of course, when the machine controls 212 are associated with an embodiment of the invention which does not provide a return valve or heaters, these functions would be omitted from the machine controls.

The operator control 320 (FIG. 9) provides a central point at which monitored data may be displayed to an operator. The operator control 320 accepts input data from the operator which may be transmitted to the monitor control 214. The operator control 320 and the monitor control 214 may be separated by a distance of from several inches to more than 5,000 feet. The operator control 320 is capable of remotely monitoring flow conditions in the spray gun 30. The operator control 320 may be located anywhere.

The pressure monitoring process is executed by a monitor controller 324 (FIG. 9) which is implemented by a microcontroller commercially available as P1C16C5X from Microchip Technologies, Inc. of Chandler, Ariz. The monitor controller 324 operates with a memory device, for example, an EPROM, 326 for storing programmed instructions controlling the operation of a data processor 328. The data processor 328 responds to the program instructions with the EPROM 326 to implement various timers and counters using registers 330. In addition, the registers 330 provide temporary storage for data being transferred between the monitor controller 324 and the machine control 212. Operating programs for the monitor controller 324 are written in a RISC assembly language associated with the microcontroller 324 and stored in the EPROM 326. An MC communication processor 332 communicates with the monitor controller 324 over a bi-directional link 336 which has an architecture similar to an RS-232 interface. The MC communication processor 332 may be implemented using a "NEURON CHIP" processor commercially available from Motorola, of Phoenix, Arizona. Development tools and software for the "NEURON CHIP" processor are commercially available from Echelon Corporation of Los Gatos, Calif.

The MC communication processor 332 and OC communication processor 342 exchange data in accordance with a data communications cycle and protocol determined by the "NEURON CHIP" processor. Some data, for example, the number of cans coated and the current measured pressure is transferred from the MC communication processor 332 to the OC communication processor 342 during a continuously repeated data transfer cycle that is executed approximately every 500 milliseconds. In addition, either of the communications processors 332 or 342 can initiate an asynchronous data transfer cycle with the other processor in response to an operator input or other process condition. For example, at different times determined by the operator or the process, the MC communication processor 332 transmits data to the OC communication processor 342 which may include, for example, power ON configuration data, installation data relating to the particle gun associated with the monitor control, newly generated error codes, newly calculated pressure limit information generated during the execution of a calibration mode, the current firing static pressures as determined by the monitor control. Further, at other times determined by the operator or the process, the OC communication processor 342 transmits data to the MC communication processor 332 which may include, for example, the current time and date, requests for data, such as, diagnostic error code information resulting from an operator actuating pushbuttons 348, etc.

The MC communication processor includes its own EPROM and RAM and also communicates with external memory 334. In addition, the MC communication processor 332 communicates with operator control 320 over network 318 which has an RS-485 architecture. The network 318 includes a transmitter receiver network interface 338 associated with the monitor control 214 and a second transmitter receiver network interface 340 located with the operator control 320. The network interfaces 338 and 340 are interconnected by a network media, or link 341 such as four wire cable.

Within the operator control 320, an OC communication processor 342 identical to MC communication processor 332 is connected to an external memory 344. The OC communication processor 342 is connected to an input/output interface 346 which in turn is connected to pushbuttons 348 and LED displays 350. The communication processor 342 is also connected to a display driver 352 which operably communicates with a display 354 such as a liquid crystal display ("LCD") or other display mechanism. The operator may use the pushbuttons 348 on the operator controls 320 to enter input data signals representing configuration data and set up parameters for the monitor controls 214.

Data entered at the operator control 320 relating to a particular monitor control is immediately transferred to that monitor control, but the data is stored in the memory associated with the operator control. Messages displayed on the LCD display 354 originate from the monitor control 214. Therefore, the OC communication processor 342 within the operator control 320 simply communicates with either the network interface 340, the I/O interface 346 or the display driver 352 and does not execute any programs that are necessary for the monitor control 214 to perform its functions. Therefore, after the operator control is used to set up the initial operating parameters in the monitor controls, the monitor controls operate independently; and the operator controls may be disconnected from the network 318. However, the operator controls have a nonvolatile memory, for example, memory with a battery back-up, in which the configuration and set-up parameters are stored for each of the guns. Therefore, in the event that a monitor control loses power or must be replaced, the operator control may be used to quickly reenter the configuration and set-up parameters.

The MC communication processor 332 functions as a communication link between the network interface 338 and the monitor controller 324. In addition, the MC communication processor 332 stores and executes programs which are used to calibrate the monitor processor. The MC communication processor 332 also transmits diagnostic data stored in memory 334 in response to requests for such data from the operator control 320. Further, the MC communication processor 332 is responsive to the gun timing signal on line 335 from the gun timer 308. The processor 332 counts the number of occurrences of the gun timing signal ON time produced by the gun timer 308 which in an intermittent coating system will correspond to the total number of objects or cans coated by the fluid dispensing gun 30. An intermittent coating system turns the spray gun 30 ON and OFF with each can coated and is distinguished from a continuous coating system; in which the gun is maintained ON continuously while objects to be coated are conveyed past the gun. The processor 332 transfers the current total number ON times counted, that is, the current can count, to the OC communication processor 342 with each regular data transfer cycle between the processors 332 and 342. The current can count for the spray gun 30 is stored in the memory 344 and is displayed by the operator control as part of the data associated with the spray gun. In addition, each time the operator uses pushbuttons 348 to reset the stored can count for the spray gun to zero, the processor 342 stores in the memory 344, for subsequent display to the operator, the date and time that the command to reset the can count for the spray gun was given by the operator. In addition, a history of times and dates of a predetermined number can count resets is stored in memory 334 by processor 332.

The monitor controller 324 samples the fluid pressure measured by the transducer 132 by periodically reading the A/D converter 356 which is connected to the transducer 132 through a signal conditioning circuit 358. The monitor controller 324 executes programs which analyze the measured pressure signals and produce fluid flow condition signals representing alarm and warning error codes to an I/O interface 360. The I/O interface generates alarm and warning signals to illuminate the appropriate LEDs 362 and operate respective alarm and warning control circuits 364, 366 within the machine control 212. Typically, the alarm warning control circuit terminates operation of the dispensing gun 30. That may be accomplished by turning OFF the gun timer 308, terminating the supply of coating from the source 38, or through a combination of operations. The warning signal may be used to adjust the quantity of coating material flow or static pressure of the coating material from the source 38. In addition, fluid flow condition signals produced by the monitor controller represent fluid flow condition data, for example, alarm and warning error codes, other flow condition data and associated message data, all of which is sent to the operator control 320. Within the operator control, the data is effective to illuminate the appropriate LEDs 350 and display messages on the display 354.

Upon power being applied to the monitor control 214, the main routine of FIG. 10 is initiated and runs continuously while power is applied to the monitor control. The routine of FIG. 10 includes a watchdog timer which checks for an iteration of the main routine each 0.5 seconds. If the routine is inadvertently stopped or otherwise hangs up, the watchdog timer times out and provides an error message to the operator. The routine executes at 400 an initialization subroutine to perform the initialization and set up that is typically required to establish default settings within the monitor control and monitor controller when power is initially applied. The main routine has three basic subroutines which represent three operating modes; a first, transmit mode transmits error codes and associated messages from the monitor control to the operator control. The second, receive mode receives data transmitted from the operator control to the monitor control. The third, monitor mode detects a characteristic of coating material fluid flow, for example, pressure through the spray gun 30 to monitor fluid flow conditions. The three different operating modes are prioritized; and within the process of FIG. 10, the order of priority is the transmit mode, the receive mode and the monitor mode; however, other orders of priority may be used.

In the absence of error codes as detected at 402, and if there is no data to be received at 404, the monitor subroutine 406 is executed. The monitor subroutine 406 detects fluid pressure conducted to the spray gun to generate various error codes and/or messages. Referring to FIG. 11, during the monitor subroutine, pressure downstream from the orifice 104 is sampled by the transducer 132 during the ON and OFF times over successive sampling periods comprised of a predetermined number, for example, 64 pressure samples. Assume that the desired, or acceptable static pressure, that is, the pressure from the fluid supply, either regulated or unregulated, when the flow control valve is closed and the gun is turned OFF, is 800 psi, and high and low static pressure alarm limits are set at 835 psi and 765 psi, respectively. The static pressure is sampled during the gun OFF time, and high and low static pressure quality indicators are produced as will be subsequently described as a function of comparing the measured static pressure to the high and low static alarm limits. The monitor subroutine then counts the occurrences of the various static pressure quality indicators during the sampling period and produces fluid flow condition signals as a function of comparing the frequencies of occurrence of the static pressure quality indicators to predetermined reference values. Fluid flow condition data is also created by measuring the average static pressure during the sampling period and comparing it to the reference static pressure value.

With reference to FIG. 11, during the spray gun 30 ON time, assume that the normal firing pressure drop across the orifice 104 is 50 psi and the static pressure is 800 psi. Therefore, the normal, or set firing pressure, that is, the pressure drop across the nozzle of the spray gun 30, will be 750 psi. High alarm ("HA"), high warning ("HW"), low warning ("LW") and law alarm ("LA") pressure limits, or pressure reference values, for the firing pressure may be set at 780 psi, 765 psi, 735 psi and 700 psi, respectively. Those limits will result in respective pressure drops across the orifice 104 of 20 psi, 35 psi, 65 psi and 100 psi. As will subsequently be explained, during an ON time sampling period, the monitor subroutine samples the fluid pressure of the coating material over continuously occurring sample periods. Each sample period includes sixty four samples, and the monitor control produces various firing pressure quality indicators as a function of comparing sampled fluid pressures to the firing pressure limits. For example, different types of firing pressure quality indicators are produced if the sampled firing pressure is either, in excess of the alarm limits, or between the warning and alarm limits, or between the warning limits. Each occurrence of the same type of firing pressure quality indicator during the sampling period is counted, and the frequency of occurrence of the low alarm, low warning, normal flow, high warning and high alarm firing pressure quality indicators are used to produce warning and alarm error codes to the operator. Error codes are also produced as a function of comparing the average pressure value measured over the sampling period to the various alarm and warning pressure limits. Some fluid flow condition signals represent alarm conditions which, by design, require immediate attention and are operative to provide immediate remedial action. Other fluid flow condition signals represent warning conditions which should be ;monitored but no immediate remedial action is required. The above pressure sampling process runs continuously during the spray gun ON and OFF times regardless of the duration of the ON and OFF times.

Referring to FIG. 10, upon any fluid flow condition signal being generated, during the next iteration through the main routine, the transmit mode is entered at 402 if any error codes have been produced, or error flags have been set during the previous iteration. If the same error was previously set, as detected at 408, there is no value in taking time to transmit the same information to the operator control. Therefore, no further action is taken. If, however, the error is different at 408, the value of the previous error is set equal to the current error at 410; and the new error codes are transmitted at 412 from their storage locations in the registers 330 of the monitor controller 324 across the data link 336 to the MC communication processor 332. Thereafter, the MC communication processor 332 transfers the error codes and messages to the network interface 338 which in turn transmits the data to the operator control 320 for display to the operator.

If the operator uses the pushbuttons 348 on the operator control 320 to provide different operating parameters for the monitor control, those parameters are transmitted from the operator control 320 to the MC communication processor 332. The MC communication processor 332 temporarily stores the data and sets a request send flag across the link 36. During the next iteration through the main routine of FIG. 4, if no error flags are set at 402 (FIG. 8), and the request send flag has been set at 404; a receive data subroutine is executed at 416 which is effective to transfer the operator entered data from the MC communication processor 332 to the monitor controller 324. If no error flags have been set at 402, and no request send flag has been set at 404, the system enters the monitor subroutine 406.

The construction and mode of operation of the machine control 212, the fluid dispensing monitor 214 and the operator control 320 is the same as disclosed in U.S. patent application Ser. No. 08/218,675, filed Mar. 28, 1994 and entitled "Monitor for Fluid Dispensing System" now U.S. Pat. No. 5,481,260. The disclosure in the aforementioned U.S. patent application Ser. No. 08/218,675, now U.S. Pat. No. 5,481,260 is hereby incorporated herein in its entirety by this reference thereto. However, it should be understood that other control and monitor apparatus could be used if desired.

Conclusion

In view of the foregoing description, it is apparent that the present invention provides a new and improved apparatus 10 for applying coating material to articles. In one specific instance, the apparatus 10 was used to apply coating material to a seam in a can 20. The coating material is conducted through a main conduit 48 which is connected with a spray gun 30. A monitor assembly 52 may include a monitor orifice 104 through which the flow of coating material is conducted. A transducer 132 is operable to provide an output signal indicative of variations in fluid pressure in the coating material at a location downstream of the monitor orifice 104.

To facilitate repair and/or replacement of the transducer 132 and/or the monitor orifice 104, a bypass conduit 100 may be provided to conduct a flow of coating material around the monitor orifice. A valve 94 may be provided to direct the flow of coating material through either the monitor orifice 104 or the bypass conduit 100.

In one embodiment of the invention (FIGS. 3–6), the monitor assembly **52*a* or 52*b* is mounted between an apparatus 16*a* which forms a tubular can body and a spray apparatus 28*a* which applies coating material to the interior of the can body. In this embodiments of the invention, the path of movement of the can bodies is such that the monitor assembly 52*a* or 52*b* is passed through the tubular can bodies. In another embodiment of the invention (FIGS. 1 and 2), the monitor assembly 52 is located ahead of the apparatus 16 which forms a can body 20**.

In the embodiment of the invention illustrated in FIG. 7, a return conduit **58*c* conducts excess coating material back to a source 38*c* of coating material. A return valve 192 may be provided in the return conduit 58*c* to block flow of coating material back to the source 38*c* during application of coating material to can bodies. When the application of coating material to can bodies is interrupted, the return valve 192 is opened to enable coating material to flow back to the source 38*c*. The control and monitor apparatus of FIGS. 9–11 may be associated with the embodiment of the invention illustrated in FIGS. 1 and 2 or with the embodiments of the invention illustrated in FIGS. 3–8**.

Having described the invention, the following is claimed:

1. An apparatus for use with a can forming machine having a welding assembly for welding seams of cans, said apparatus comprising a can coating assembly connected with one end portion of the welding assembly and operable to coat seams in cans formed by the can forming machine, a monitor assembly disposed adjacent to an end portion of the welding assembly opposite from said can coating assembly, a conduit extending from said monitor assembly along said welding assembly to said can coating assembly to conduct a flow of coating material from said monitor assembly to said can coating assembly, said monitor assembly including a pressure transducer which is exposed to fluid pressure in the flow of coating material from said monitor assembly to said conduit and which is operable to provide an output signal which is a function of the fluid pressure in the flow of coating material from said monitor assembly.

2. An apparatus as set forth in claim 1 wherein said monitor assembly includes an orifice through which coating material is conducted, said transducer being exposed to the flow of coating material at a location downstream of said orifice.

3. An apparatus as set forth in claim 2 wherein said monitor assembly includes a bypass passage to conduct coating material around said orifice.

4. An apparatus as set forth in claim 3 wherein said monitor assembly includes a first valve at a first end of said bypass passage and a second valve at a second end of said bypass passage, said first and second valves being operable between a closed condition blocking conduction of coating material through said bypass passage and an open condition enabling coating material to be conducted through said bypass passage.

5. An apparatus as set forth in claim 1 wherein said can coating assembly is operable between an active condition in which said can coating assembly is operable to direct coating material toward a seam in a can and an inactive condition in which said can coating assembly is inoperable to direct coating material toward a seam in a can.

6. An apparatus as set forth in claim 1 wherein said monitor assembly includes a monitor control which is connected with said pressure transducer, said pressure transducer being effective to provide an output signal which is transmitted to said monitor control and is a function of the fluid pressure in the flow of coating material during operation of said can coating assembly, said monitor control being operable to compare the fluid pressure in the flow of coating material during operation of said can coating assembly with a desired fluid pressure and to provide an error signal in response to the fluid pressure in the flow of coating material differing from the desired fluid pressure by more than a predetermined amount during operation of said can coating assembly.

7. An apparatus as set forth in claim 1 wherein said monitor assembly includes a monitor control which is connected with said pressure transducer and stores data representing a desired minimum coating material fluid pressure during operation of said can coating assembly, said monitor control being operable to compare the output from said transducer with the stored data representing a desired minimum coating material fluid pressure during operation of said can coating assembly and to provide an error signal if the output from said transducer represents a coating material fluid pressure which is less than the minimum desired coating material fluid pressure during operation of said can coating assembly.

8. An apparatus as set forth in claim 1 wherein said monitor assembly includes a monitor control which is connected with said pressure transducer and stores data representing a desired maximum coating material fluid pressure during operation of said can coating assembly, said monitor control being operable to compare the output from said transducer with the stored data representing a desired maximum coating material fluid pressure during operation of said can coating assembly and to provide an error signal if the output from said transducer represents a coating material fluid pressure which is greater than a maximum desired coating material fluid pressure during operation of said can coating assembly.

9. An apparatus as set forth in claim 1 further including a return conduit for conducting coating material away from said can coating assembly, a return valve connected with said return conduit and operable between a closed condition blocking flow of coating material through said return conduit and an open condition enabling fluid to flow through said return conduit, said can coating assembly including an opening through which coating material is directed toward the seam in each of the cans in turn and a coating material flow control valve operable between a closed condition blocking flow of coating material through said opening and an open condition enabling coating material to flow through said opening, and control means for effecting operation of said return valve from the open condition to the closed condition upon operation of said coating material flow control valve from the closed condition to the open condition.

10. An apparatus as set forth in claim 9 wherein said control means is effective to operate said return valve from the closed condition to the open condition after operation of said coating material flow control valve from the open condition to the closed condition.

11. An apparatus as set forth in claim 9 wherein said return conduit is connected with said main conduit at a location upstream from said monitor assembly, said apparatus further including heater means for heating coating material disposed in said main conduit downstream from said monitor assembly when said return valve is in the open condition.

12. An apparatus for use with a can forming machine having a welding assembly for welding seams of cans, said apparatus comprising a spray gun connected with the welding assembly for directing a flow of coating material toward a seam formed in a can body by the can forming machine, a main conduit connected with said spray gun for conducting a flow of coating material to said spray gun, an orifice connected with said main conduit and through which the flow of coating material is conducted to said spray gun, a transducer connected with said main conduit and operable to provide an output signal indicative of variations in fluid pressure in the coating material at a location downstream of said orifice, and a bypass conduit connected with said main conduit at a location upstream of said orifice and at a location downstream of said orifice to conduct a flow of coating material around said orifice.

13. An apparatus as set forth in claim 12 further including a valve connected with said main conduit and said bypass conduit, said valve being operable between a first condition blocking flow of coating material through said bypass conduit and enabling coating material to flow through said orifice and a second condition blocking flow of coating material through said orifice and enabling coating material to flow through said bypass conduit.

14. An apparatus as set forth in claim 12 wherein said apparatus includes a first valve connected with said main conduit and said bypass conduit at a location upstream of said orifice, said first valve being operable between a first condition blocking flow of coating material through said bypass conduit and enabling coating material to flow through said orifice and a second condition blocking flow of coating material through said orifice and enabling coating material to flow through said bypass conduit, and a second valve connected with said main conduit and said bypass conduit at a location downstream of said orifice and said transducer, said second valve being operable between a first condition blocking flow of coating material through said bypass conduit and enabling coating material to flow through said main conduit from said orifice and a second condition blocking flow of coating material through said main conduit from said orifice and enabling coating material to flow through said bypass conduit.

15. An apparatus as set forth in claim 14 wherein said transducer is connected with said main conduit at a location between said first and second valves.

16. An apparatus as set forth in claim 12 further including a return conduit for conducting coating material away from said spray gun, a return valve connected with said return conduit and operable between a closed condition blocking flow of coating material through said return conduit and an open condition enabling fluid to flow through said return conduit, said spray gun including a nozzle through which coating material is directed toward a seam formed in each can body formed by the can forming machine in turn and a nozzle valve connected with said nozzle and operable between a closed condition blocking flow of coating material through said nozzle and an open condition enabling coating material to flow through said nozzle, and control means for effecting operation of said return valve from the open condition to the closed condition upon operation of said nozzle valve from the closed condition to the open condition.

17. An apparatus as set forth in claim 16 wherein said control means is effective to operate said return valve from the closed condition to the open condition after operation of said nozzle valve from the open condition to the closed condition.

18. An apparatus as set forth in claim 16 wherein said return conduit is connected with said main conduit at a location upstream from said orifice and said transducer, said apparatus further including heater means for heating coating material disposed in said main conduit downstream from said orifice and said transducer when said return valve is in the open condition.

19. An apparatus comprising a can forming machine having a welding assembly for welding seams of cans, a coating assembly disposed along a path of movement of can bodies from said welding assembly, said coating assembly being connected with said welding assembly, said apparatus further including a main conduit for conducting a flow of coating material to said coating assembly, said coating assembly being operable to apply coating material conducted through said main conduit to a seam formed in a can body by said welding assembly, and a monitor assembly connected with said main conduit and disposed between said welding assembly and said coating assembly along the path of movement of can bodies, said monitor assembly being operable to provide an output signal which varies as a function of variations in fluid pressure in coating material conducted through said main conduit to said coating assembly.

20. An apparatus as set forth in claim 19 wherein said monitor assembly includes an orifice connected with said main conduit at a location between said welding assembly and said coating assembly and through which the flow of coating material is conducted to said spray gun and a transducer connected with said main conduit and operable to provide an output signal indicative of variations in fluid pressure in the coating material at a location downstream of said orifice.

21. An apparatus as set forth in claim 19 further including a bypass conduit connected with said main conduit at a location upstream of said orifice and at a location downstream of said orifice, and a valve connected with said main conduit and said bypass conduit, said valve being operable between a first condition blocking flow of coating material through said bypass conduit and enabling coating material to flow through said main conduit and a second condition blocking flow of coating material through said main conduit and enabling coating material to flow through said bypass conduit, said bypass conduit and said valve being disposed between said welding assembly and said coating assembly along the path of movement of can bodies.

22. An apparatus as set forth in claim 19 wherein the can bodies have a tubular configuration, said welding assembly being operable to form a seam in a tubular can body while the tubular can body extends around at least a portion of said welding assembly, said coating assembly being operable to apply coating material to an interior surface of each of the tubular can bodies in turn while the tubular can body extends around at least a portion of said coating assembly, said monitor assembly being passed through each of said tubular can bodies in turn during movement of each of said tubular can bodies in turn along the path from said welding assembly to said coating assembly.

23. An apparatus as set forth in claim 22 further including a return conduit for conducting coating material away from said coating assembly, a return valve connected with said return conduit and operable between a closed condition blocking flow of coating material through said return conduit and an open condition enabling fluid to flow through said return conduit, said coating assembly including an opening through which coating material is directed toward the seam on each of the can bodies in turn and a coating material flow control valve operable between a closed condition blocking flow of coating material through said opening and an open condition enabling coating material to flow through said opening, and control means for effecting operation of said return valve from the open condition to the closed condition upon operation of said coating material flow control valve from the closed condition to the open condition.

24. An apparatus as set forth in claim 23 wherein said control means is effective to operate said return valve from the closed condition to the open condition after operation of said coating material flow control valve from the open condition to the closed condition.

25. An apparatus as set forth in claim 23 wherein said return conduit is connected with said main conduit at a location upstream from said monitor assembly, said apparatus further including heater means for heating coating material disposed in said main conduit downstream from said monitor assembly when said return valve is in the open condition.

26. An apparatus for use with a can forming machine having a welding assembly for welding seams of cans, said apparatus comprising a spray gun connected with the welding assembly, said spray gun includes a nozzle which directs a flow of coating material toward a seam formed in a can body by the can forming machine and a nozzle valve which is operable between an open condition enabling coating material to flow through said nozzle and a closed condition blocking flow through said nozzle, a main conduit connected with said spray gun for conducting a flow of coating material to said spray gun, a return conduit for conducting coating material away from said spray gun, a return valve connected with said return conduit and operable between a closed condition blocking flow of coating material through said return conduit and an open condition enabling coating material to flow through said return conduit, and control means for effecting operation of said return valve from the open condition to the closed condition upon operation of said nozzle valve from the closed condition to the open condition.

27. An apparatus as set forth in claim 26 wherein said control means effects operation of said return valve from the closed condition to the open condition after said nozzle valve has been operated from the open condition to the closed condition and has remained in the closed condition for a predetermined length of time.

28. An apparatus as set forth in claim 26 further including heater means for heating coating material disposed in at least a portion of said main conduit when said return valve is in the open condition.

29. An apparatus comprising a can forming machine having a welding assembly for welding seams of tubular can bodies, a spray gun connected with one end of said welding assembly and aligned with a path of movement of tubular can bodies from said welding assembly so that said spray gun is at least partially enclosed by each of said tubular can bodies in turn, said spray gun being operable to direct a flow of coating material toward a seam in each of the tubular can bodies in turn during movement of the tubular can bodies along the path of movement of the tubular can bodies from said welding assembly, a main conduit connected with said spray gun for conducting a flow of coating material to said spray gun, an orifice connected with said main conduit at a location adjacent to said one end of said welding assembly and through which the flow of coating material is conducted to said spray gun, a transducer connected with said main conduit and operable to provide an output signal indicative of variations in fluid pressure in the coating material at a location downstream of said orifice, said main conduit, orifice and transducer being at least partially enclosed by each of the tubular can bodies in turn during movement of the tubular can bodies along the path of movement of the tubular can bodies from said welding assembly.

30. An apparatus as set forth in claim 29 wherein said spray gun includes a nozzle through which a flow of coating material is directed toward a seam formed in each of the tubular can bodies in turn and a nozzle valve which is operable between an open condition enabling coating material to flow through said nozzle and a closed condition blocking flow through said nozzle, a return conduit for conducting coating material away from said spray gun, a return valve connected with said return conduit and operable between a closed condition blocking flow of coating material through said return conduit and an open condition enabling coating material to flow through said return conduit, and control means for effecting operation of said return valve from the closed condition to the open condition after said nozzle valve has been operated from the open condition to the closed condition and for effecting operation of said return valve from the open condition to the closed condition prior to operation of said nozzle valve from the closed condition to the open condition.

31. An apparatus as set forth in claim 30 wherein a portion of said return conduit and return valve are disposed adjacent to said one end of said welding assembly and are at least partially enclosed by each of the tubular can bodies in turn during movement of the tubular can bodies along the path of movement of the tubular can bodies from said welding assembly.

32. An apparatus as set forth in claim 31 further including heater means disposed adjacent to said one end of said welding assembly for heating coating material in at least a portion of said main conduit.

33. An apparatus as set forth in claim 29 further including a bypass conduit connected with said main conduit at a location upstream of said orifice and at a location downstream of said orifice to conduct a flow of coating material around said orifice, said bypass conduit being disposed adjacent to said one end portion of said welding assembly and being at least partially enclosed by each of the tubular can bodies in turn during movement of the tubular can bodies along the path of movement of the tubular can bodies form said welding assembly.

34. An apparatus as set forth in claim 33 wherein said apparatus includes a first valve connected with said main conduit and said bypass conduit at a location upstream of said orifice and adjacent to said one end of said welding assembly, said first valve being operable between a first condition blocking flow of coating material through said bypass conduit and enabling coating material to flow through said orifice and a second condition blocking flow of coating material through said orifice and enabling coating material to flow through said bypass conduit, and a second valve connected with said main conduit and said bypass conduit at a location downstream of said orifice and said transducer and adjacent to said one end of said welding assembly, said second valve being operable between a first condition blocking flow of coating material through said bypass conduit and enabling coating material to flow through said main conduit from said orifice and a second condition blocking flow of coating material through said main conduit from said orifice and enabling coating material to flow through said bypass conduit, said first and second valves being enclosed by each of said tubular can bodies in turn during movement of the tubular can bodies along the path of movement of the tubular can bodies from said welding assembly.

35. An apparatus as set forth in claim 34 wherein said transducer is connected with said main conduit at a location between said first and second valves.

36. An apparatus as set forth in claim 34 further including a return conduit for conducting coating material away from said spray gun, a return valve connected with said return conduit and operable between a closed condition blocking flow of coating material through said return conduit and an open condition enabling fluid to flow through said return conduit, said spray gun including a nozzle through which coating material is directed toward each of the articles in turn and a nozzle valve connected with said nozzle and operable between a closed condition blocking flow of coating material through said nozzle and an open condition enabling coating material to flow through said nozzle, and control means for effecting operation of said return valve from the open condition to the closed condition upon operation of said nozzle valve from the closed condition to the open condition, said return valve being connected with said return conduit at a location adjacent to said one end portion of said welding assembly and being enclosed by each of the tubular can bodies in turn during movement of the tubular can bodies along the path of movement of the tubular can bodies from said welding assembly.

37. An apparatus for use with a can forming machine having a welding assembly for welding seams of cans, said apparatus comprising a can coating assembly connected with one end portion of the welding assembly and operable to coat seams in cans formed by the can forming machine, a monitor assembly, and a conduit which extends from a source of coating material to said monitor assembly and extends from said monitor assembly to said can coating assembly to conduct a flow of coating material to said can coating assembly, said monitor assembly including an orifice through which coating material is conducted, a pressure transducer which is exposed to fluid pressure in the flow of coating material from said orifice and which is operable to provide an output signal which is a function of the fluid pressure in the flow of coating material from said orifice, a bypass passage, a first valve connected with a first end of said bypass passage and said conduit, and a second valve connected with a second end of said bypass passage and said conduit, said orifice and pressure transducer being disposed between said first and second valves, said first and second valves being operable between a first condition blocking a flow of coating material through said bypass passage and enabling coating material to flow through said orifice and a second condition blocking a flow of coating material through said orifice and enabling coating material to flow through said bypass passage.

38. An apparatus as set forth in claim 37 wherein said monitor assembly includes a monitor control which is connected with said pressure transducer, said pressure transducer being effective to provide an output signal which is transmitted to said monitor control and is a function of the fluid pressure in the flow of coating material during operation of said can coating assembly, said monitor control being operable to compare the fluid pressure in the flow of coating material during operation of said can coating assembly with a desired fluid pressure and to provide an error signal in response to the fluid pressure in the flow of coating material differing from the desired fluid pressure by more than a predetermined amount during operation of said can coating assembly.

39. An apparatus as set forth in claim 37 wherein said monitor assembly includes a monitor control which is connected with said pressure transducer and stores data representing a desired minimum coating material fluid pressure during operation of said can coating assembly, said monitor control being operable to compare the output from said transducer with the stored data representing a desired minimum coating material fluid pressure during operation of said can coating assembly and to provide an error signal if the output from said transducer represents a coating material fluid pressure which is less than the minimum desired coating material fluid pressure during operation of said can coating assembly.

40. An apparatus as set forth in claim 37 wherein said monitor assembly includes a monitor control which is connected with said pressure transducer and stores data representing a desired maximum coating material fluid pressure during operation of said can coating assembly, said monitor control being operable to compare the output from said transducer with the stored data representing a desired maximum coating material fluid pressure during operation of said can coating assembly and to provide an error signal if the output from said transducer represents a coating material fluid pressure which is greater than a maximum desired coating material fluid pressure during operation of said can coating assembly.

41. An apparatus as set forth in claim 37 further including a return conduit for conducting coating material away from said can coating assembly, a return valve connected with said return conduit and operable between a closed condition blocking flow of coating material through said return conduit and an open condition enabling fluid to flow through said return conduit, said can coating assembly including an opening through which coating material is directed toward the seam in each of the cans in turn and a coating material flow control valve operable between a closed condition blocking flow of coating material through said opening and an open condition enabling coating material to flow through said opening, and control means for effecting operation of said return valve from the open condition to the closed condition prior to operation of said coating material flow control valve from the closed condition to the open condition.

42. An apparatus as set forth in claim 41 wherein said control means is effective to operate said return valve from the closed condition to the open condition after operation of said coating material flow control valve from the open condition to the closed condition.

* * * * *